US005887224A

United States Patent [19]

Mizuishi et al.

[11] Patent Number: 5,887,224

[45] Date of Patent: Mar. 23, 1999

[54] IMAGE FORMING DEVICE WITH IMPROVED MIXING OF CIRCULATED DEVELOPER WITH REPLENSIHED TONER

[75] Inventors: Haruji Mizuishi, Tokyo; Masaru Tanaka, Yokohama; Shigeru Watanabe, Yokohama; Kenzo Tatsumi, Yokohama; Toshitaka Yamaguchi, Ohmiya; Takeo Suda, Tokyo; Hiroshi Yoshinaga, Ichikawa; Ken Amemiya, Tokyo; Mayumi Yoshida, Kawasaki, all of Japan

[73] Assignee: Ricoh Company, Ltd., Tokyo, Japan

[21] Appl. No.: 862,695

[22] Filed: May 23, 1997

[30] Foreign Application Priority Data

| | | | |
|---|---|---|---|
| May 31, 1996 | [JP] | Japan | 8-138472 |
| May 31, 1996 | [JP] | Japan | 8-138473 |
| May 29, 1996 | [JP] | Japan | 8-134548 |
| Jun. 21, 1996 | [JP] | Japan | 8-161812 |
| Apr. 7, 1997 | [JP] | Japan | 9-088479 |

[51] Int. Cl.[6] ..... G03L 15/08

[52] U.S. Cl. ..... 399/62; 399/102; 399/256; 399/359

[58] Field of Search ..... 399/103, 104, 399/105, 62, 63, 754, 255, 256, 258, 359

[56] References Cited

U.S. PATENT DOCUMENTS

| | | | |
|---|---|---|---|
| 5,077,584 | 12/1991 | Tanaka et al. . | |
| 5,109,254 | 4/1992 | Oka et al. . | |
| 5,557,382 | 9/1996 | Tatsumi et al. . | |
| 5,682,583 | 10/1997 | Ito et al. | 399/254 |

FOREIGN PATENT DOCUMENTS

| | | |
|---|---|---|
| 5-249828 | 9/1993 | Japan . |

*Primary Examiner*—Joan Pendegrass
*Attorney, Agent, or Firm*—Oblon, Spivak, McClelland, Maier & Neustadt, P.C.

[57] ABSTRACT

There is provided an image forming device capable of preventing smudges on the background of an image due to excess toner replenishment caused by a failure in stirring developer and toner enough to charge the toner or scattering of replenished toner without being charged. A toner conveying member for conveying replenished toner from a toner replenishing portion through a toner replenishing port to a developer stirring and conveying member is constructed by a screw member unitarily formed with the developer stirring and conveying member. The screw member has a spiral conveying fin capable of conveying the replenished toner at relatively high speed. The replenished toner is delivered to a toner replenishing portion provided in the upstream of a developer receiving portion of the screw member.

21 Claims, 14 Drawing Sheets

IMAGE FORMING DEVICE WITH IMPROVED MIXING OF CIRCULATED DEVELOPER WITH REPLENSIHED TONER

BACKGROUND OF THE INVENTION

1. Field of the Invention

This invention relates to an image forming device such as a copying machine, a printer or a facsimile and, more particularly, to an image forming device using a developer with two components.

2. Discussion of the Background

A related image forming device such as a copying machine, a printer or a facsimile, includes a developer stirring and conveying member for stirring and conveying a two-component developer to a developing sleeve developing an electrostatic latent image formed on a photosensitive body; a new toner replenishing member for replenishing new toner to a toner conveying member provided through a toner conveying path that communicates with a developer stirring and conveying path of the developer stirring and conveying member; and a recovered toner conveying member for conveying recovered toner, removed from the photosensitive body, to the toner conveying member for use as recycle toner.

The developer stirring and conveying member includes a first developer stirring and conveying member positioned along and substantially in parallel to the developing sleeve and a second developer stirring and conveying member positioned substantially in parallel to the first developer stirring and conveying member. These members are designed to convey the developer in directions which are different from each other.

A partition is provided between the first developer stirring and conveying member and the second developer stirring and conveying member. Developer receiving portions are formed at front and back sides of the partition, respectively, so that the conveyed developer can be circulated through the developer receiving portions. The developer is conveyed in this circulatory system while substantially maintaining a constant speed even in the developer receiving portions on purpose to prevent the developer from accumulating or decreasing at the ends of each developer stirring and conveying member. If the first and second developer stirring and conveying members convey the developer at different speeds, e.g., when the conveying speed of the first developer stirring and conveying member is slower than that of the second developer stirring and conveying member, there exists no developer (especially no carrier) in the leading portion of the second developer stirring and conveying member; and only the replenished toner and the recycle toner are conveyed to the second developer stirring and conveying member. This may cause a toner concentration detecting sensor to make an error in detection.

The first developer stirring and conveying member and the second developer stirring and conveying member are each constructed by an elliptic fin member having a plurality of fins each formed by notching part of an elliptic plate and slantingly arranged, mainly aiming at stirring of the developer. This type of image forming device is required to stir the developer enough to charge the toner to a predetermined potential before development on purpose to prevent the occurrence of an uneven density of an image caused by insufficient mixing of the toner with the carrier of the developer; and further, to prevent the occurrence of smudges on the background of the image due to insufficient charge of the toner.

That is, the first developer stirring and conveying member and the second developer stirring and conveying member are required to convey the developer at a relatively low speed so that the developer can be stirred enough to charge the toner. For this reason, these members are each constructed by an elliptic fin member having a plurality of fins each formed by notching part of an elliptic plate and slantingly arranged.

The toner conveying path communicates with the second developer stirring and conveying member, and the toner conveying member provided through the toner conveying path is formed into a screw-like shape.

Re-use of the toner recovered from the photosensitive body as recycle toner allows a reduction in the number of times new toner is replenished. This is particularly effective in a compact image forming device employing such a device called a process cartridge or a photosensitive unit, in which image forming units such as a developing unit and a cleaning station arranged around the photosensitive body are unitarily formed with the photosensitive body, and which therefore is incapable of making the storage capacity of the developer and replenishing toner large.

The recycle toner is, however, used and recovered toner that has been removed from the surface of the photosensitive body, and is fairly condensed compared to the new toner because the recovered toner is circulated and conveyed in the condition that it is pushed into the toner conveying means by the recovered toner circulating and conveying means. It is therefore difficult to mix such condensed recycle toner with the carrier of the two-component developer, and further, it is difficult to charge the recycle toner. For this reason, the reuse of the condensed recovered-toner as the recycle toner causes insufficient dispersion of the toner into the developer and hence uneven or unstable charge of the toner. Therefore a problem arises that smudges on the background of an image occur. Such tendency is remarkable in a compact image forming device employing the process cartridge or the photosensitive body unit, because it is incapable of making the developer stirring and conveying path long due to its construction.

Further, since the developer conveying speed is relatively slow in this type of image forming device, it is easy to accumulate the developer near the developer receiving portions.

Furthermore, in conventional image forming devices, the toner replenished from a toner replenisher is fed to the second developer stirring and conveying member through the toner conveying member provided separately from the second developer stirring and conveying member.

Since the developer near one of the developer receiving portions that communicates with the downstream of the developer circulating path of the first developer stirring and conveying member is relatively heavy with a large amount of carrier due to toner consumption, the developer is accumulated near the developer receiving portion in the conventional image forming devices. This may cause a backflow of the developer into the toner replenishing path or a slowdown in dispersing the toner into the developer after being fed to the second developer stirring and conveying member. In these cases, the toner concentration in a toner concentration detecting position reaches a reference value very slowly even after a required amount of toner has been replenished. This causes excess toner replenishment and therefore the same problem arises that smudges on the background of an image occur. The problem is remarkable in a compact image forming device.

Referring now to FIG. 27, a reason for the nonuniform mixing of the circulated developer with the replenished toner will be described from another standpoint. In the drawing, the developer is represented by circles with reference symbol G and the toner is represented by scattered dots with reference symbol Tn for convenience sake. A first developer stirring and conveying member 101 conveys the developer G to a second developer stirring and conveying member 104 (only a toner conveying member 102 is shown in the drawing) provided at the right side of the first developer stirring and conveying member 101 when viewed from the drawing. In this case, the first developer stirring and conveying member 101 rotates in a counterclockwise direction. The second developer stirring and conveying member 104 also rotates in a counterclockwise direction to stir and convey the toner Tn and the developer G toward the back side of the plane of the drawing.

The toner Tn replenished to the toner conveying member 102 is accumulated by gravity on a casing 103 and at the lower side of the toner conveying member 102. As shown in FIG. 27, the accumulated toner Tn is slid on the upper surface of the casing 103 and sent to the developer receiving portion as a screw vane 102*a* rotates in the lower portion of the toner conveying member 102. On the other hand, the developer G sent from the first stirring and conveying member 101 to the second stirring and conveying member 104 is fed along the casing 103 with a flat plane to the lower portion of the toner conveying member 102, as shown by an arrow 106 in FIG. 27, where the toner Tn is accumulated. The developer G is thus delivered from the first stirring and conveying member 101 to the second stirring and conveying member 104 through the developer receiving portion in FIG. 27 so that the developer G will join the toner Tn in the developer receiving portion.

When the developer G joins the toner Tn, the first stirring and conveying member 101 rotates to feed the developer G, having a weight which is heavier than the toner Tn, along the plane of the casing 103 into the lower portion of the second stirring and conveying member 104 as shown by the arrow 106. Since the toner Tn which is lighter in weight than the developer G is pushed up by the developer G, it is difficult to disperse the toner Tn into the developer G, and hence it is difficult to cause friction between the toner Tn and the carrier included in the conveyed developer G so as to charge the toner Tn. The use of the toner insufficiently charged for development causes defective development such as smudges on the background of an image. If toner is replenished with the toner concentration detected from the toner that has not yet been charged enough with friction, proper toner concentration cannot be obtained.

In such a related image forming device, the replenished toner is fed from the upper side of the end of the second developer stirring and conveying member through a toner replenishing port. The replenished toner falls on the screw vane. Since the developer stirring and conveying member generally rotates at a speed of 200 rpm or higher and the toner consists of micro-particles of 3 to 12 $\mu$m, some particles of the replenished toner cannot fall from the toner replenishing port to the lower side, and may be scattered and suspended in the air or moved on the surface of the developer without being mixed and stirred with the developer, particularly with the carrier. Such toner directly arrives at the developing sleeve and the developer around the developing sleeve without being charged or with weak charging and causes smudges on the background of an image. Such scattering of the toner also causes stains in the device.

Further, in an image forming device with such a construction, the developer stirring and conveying direction is typically limited to the axial direction of the developer stirring and conveying member, and the location of the toner concentration detecting means (see Japanese patent published application No. 63-28305 or Japanese patent laid-open application No. 58-55952) for detecting toner concentration is also restricted. Therefore, in such an image forming device, the toner concentration in the developer differs depending upon the positions within the developing unit and the detecting result of detecting toner concentration depends on the position where the toner concentration detecting means is positioned within the developing unit. Also, the bulk of the developer is changed within the developing unit depending on the toner replenishment timing and the amount of replenished toner. The deviation of the toner concentration in the developer within the developing unit causes uneven density of the image, and it further causes smudges on the background of the developed image depending upon the toner replenishment timing and the amount of replenished toner. It may further cause an overflow of the toner excessively replenished depending on the toner replenishment timing and the amount of replenished toner.

An easy and typical way to solve the above problems is to extend the length of the developing casing or the partition. Such an approach to the conventional problems allows a prevention of the movement of the scattered or floating toner particles, but on the other hand could resist the movement of the developer. The approach is also insufficient for responding to a change in level of the developer surface caused when toner has been replenished.

SUMMARY OF THE INVENTION

The present invention has been made in view of such problems and to solve and resolve these problems. Accordingly, an object of the present invention is to provide an image forming device capable of preventing smudges on the background of an image due to a failure in mixing and stirring developer and toner enough to charge the toner or a scattering of the toner without being charged.

In order to achieve the above object, a first aspect of the present invention provides an image forming device having a developer stirring and conveying member for stirring and conveying developer to a developer carrier developing an electrostatic latent image on an image carrier; a toner conveying member provided through a toner conveying path for conveying toner to a developer stirring and conveying path of the developer stirring and conveying member that communicates with the toner conveying path; a new toner replenishing member for replenishing new toner to the toner conveying member; and a recovered toner conveying member for conveying toner, recovered from the surface of the image carrier, to the toner conveying member, wherein the recovered toner is conveyed upstream of a new toner replenishing portion of the toner conveying path.

A second aspect of the present invention is based on the first aspect of the present invention, wherein the conveying speed of the toner conveying member is set higher than that of the developer stirring and conveying member.

A third aspect of the present invention provides an image forming device having a developer stirring and conveying member for stirring and conveying developer to a developer carrier developing an electrostatic latent image on an image carrier; a toner conveying member provided through a toner conveying path for conveying toner to a developer stirring and conveying path of the developer stirring and conveying member that communicates with the toner conveying path; and a toner replenishing member for replenishing toner to the toner conveying member, wherein the developer located at the lowermost-stream side of the developer stirring and conveying member is conveyed downstream of a toner replenishing portion of the toner conveying path so that the developer will be circulated.

A fourth aspect of the present invention is based on the third aspect of the present invention, wherein the conveying speed of the toner conveying member is set higher than that of the developer stirring and conveying member.

A fifth aspect of the present invention is based on the third aspect of the present invention, wherein a chevron-like protrusion is formed on the bottom of a developer conveying portion located at the lowermost-stream side of the developer stirring and conveying member so that the developer will be conveyed from the upside of the toner conveying path.

A sixth aspect of the present invention is based on the third aspect of the present invention, wherein a toner receiving portion of the toner conveying member for receiving toner replenished from the toner replenishing portion is provided in a position deviated from the rotation axis of the toner conveying member.

A seventh aspect of the present invention is based on the sixth aspect of the present invention, wherein the toner receiving portion of the toner conveying member rotates in the same direction as the toner is replenished from the toner replenishing portion.

An eighth aspect of the present invention is based on the third aspect of the present invention, wherein the developer conveying portion located at the lowermost-stream side of the developer stirring and conveying member and the toner receiving portion of the toner conveying member are formed at opposite sides with respect to the rotation axis of the toner conveying member.

A ninth aspect of the present invention provides an image forming device having a developer stirring and conveying member which is provided with a developer receiving portion for receiving circulated developer and a toner replenishing portion for receiving replenished toner, the toner replenishing portion being located outside of the developer receiving portion in the axial direction of the developer stirring and conveying member, wherein the developer stirring and conveying member receives developer from the upside thereof through the developer receiving portion and toner from the downside thereof through the toner replenishing portion, and a toner concentration detecting unit is put in a position in which the developer and the toner are mixed well by the developer stirring and conveying member.

A tenth aspect of the present invention is based on the ninth aspect of the present invention, wherein when the developer stirring and conveying member for receiving developer is used as a second developer stirring and conveying member, a first developer stirring and conveying member is provided in the lateral direction of the second developer stirring and conveying member such that the first and second developer stirring and conveying members stand side by side, the developer being delivered from the first developer stirring and conveying member to the second developer stirring and conveying member through the developer receiving portion while rotating the first developer stirring and conveying member in a direction in which the developer is scraped up and fed to the second developer stirring and conveying member, with a portion of a lower casing between the first developer stirring and conveying member and the second developer stirring and conveying member being formed into a chevron-like shape corresponding to a locus of rotation of the first developer stirring and conveying member and the second developer stirring and conveying member.

An eleventh aspect of the present invention provides an image forming device having a developer stirring and conveying member which is provided with a developer receiving portion for receiving circulated developer and a toner replenishing portion for receiving replenished toner, the toner replenishing portion being located outside of the developer receiving portion in the axial direction of the developer stirring and conveying member, wherein the developer stirring and conveying member receives developer from the upside through the developer receiving portion and toner from the downside through the toner replenishing portion, and a toner concentration detecting unit is positioned off the lower side of said developer stirring and conveying member as viewed from the axial direction of the developer stirring and conveying member.

A twelfth aspect of the present invention provides an image forming device having a developer carrier, a plurality of developer stirring and conveying members arranged horizontally along the developer carrier, a partition provided between the developer stirring and conveying members, connecting passages provided at both ends of the partition so that the developer can turn back therethrough, and toner replenishing means for replenishing toner from the end portion of one of the developer stirring and conveying members, in which an electrostatic latent image formed on an image carrier is made visible with a two-component developer including toner and carrier to form a developed image, wherein a scattering prevention member is provided above one of the developer stirring and conveying members located farthest away from the developer carrier and along the axial direction of the developer stirring and conveying member so that toner particles scattered when replenishing the toner cannot directly arrive at the developer carrier or the developer around the developer carrier.

A thirteenth aspect of the present invention is based on the twelfth aspect of the present invention, wherein the scattering prevention member is positioned on the side of the partition with respect to the rotation axis of the developer stirring and conveying member that is the farthest one from the developer carrier of all the developer stirring and conveying members.

A fourteenth aspect of the present invention is based on the twelfth or thirteenth aspects of the present invention, wherein the upper end of the partition is located in a position higher than the lower end of the scattering prevention member.

A fifteenth aspect of the present invention is based on the twelfth, thirteenth or fourteenth aspects of the present invention, wherein the upper end of the partition is such that the toner replenishing side is higher than the other side.

A sixteenth aspect of the present invention is based on the twelfth, thirteenth, fourteenth or fifteenth aspects of the present invention, wherein the lower end of the scattering prevention member is such that the toner replenishing side is lower than the other side.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 8(*b*) is a schematic perspective view showing conveying states of recycle toner in the embodiment of the present invention;

FIG. 10(*b*) is a sectional view showing a structure of a developer receiving portion according to another embodiment of the present invention, where a screw member as a toner delivering member rotates in a clockwise direction;

FIG. 11(*b*) is a sectional view showing a structure of a toner replenishing portion according to another embodiment of the present invention, where a screw member as a toner delivering member rotates in a clockwise direction;

FIG. 12(*b*) is a sectional view showing the positional relationship between a developer receiving portion and a toner replenishing portion according to another embodiment of the present invention, where a screw member as a toner delivering member rotates in a clockwise direction;

DESCRIPTION OF THE PREFERRED EMBODIMENT

Figure 1:
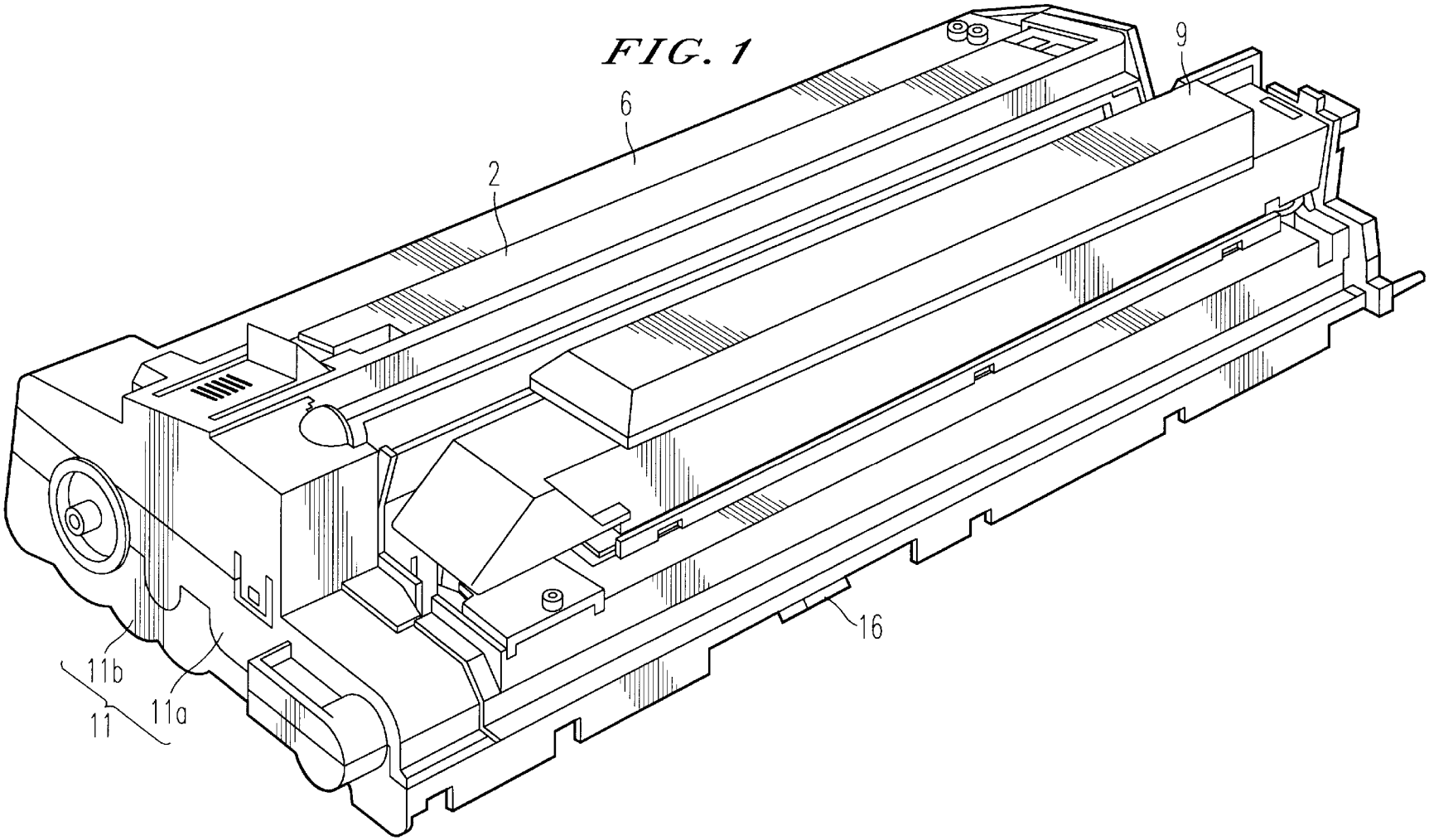
FIG. 1 is a perspective view showing the outside of the main parts of an image forming device according to an embodiment of the present invention.
Figure 2:
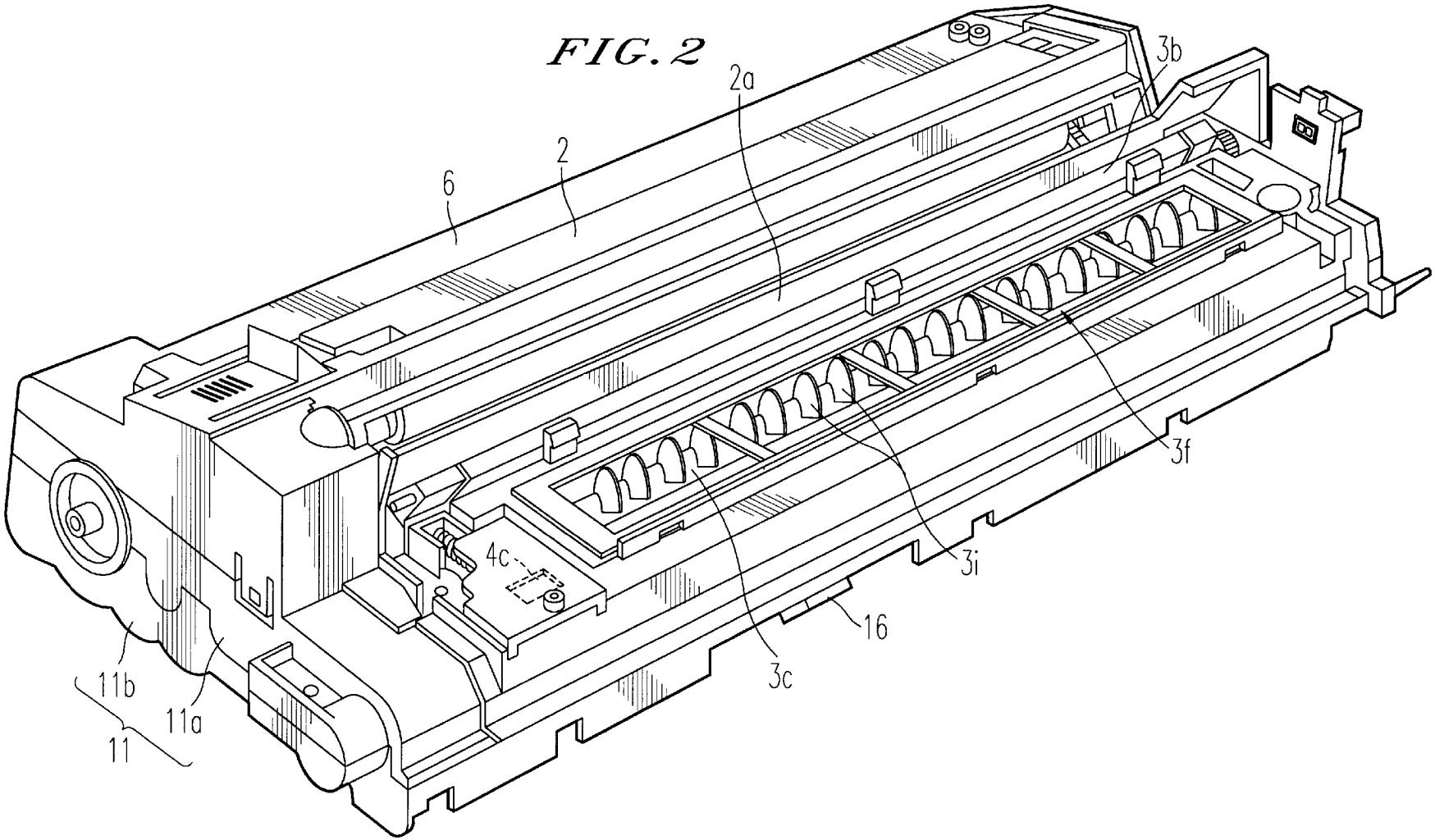
FIG. 2 is a perspective view showing the outside of the main parts of the image forming device according to the embodiment, where a developer case is removed.
Figure 3:
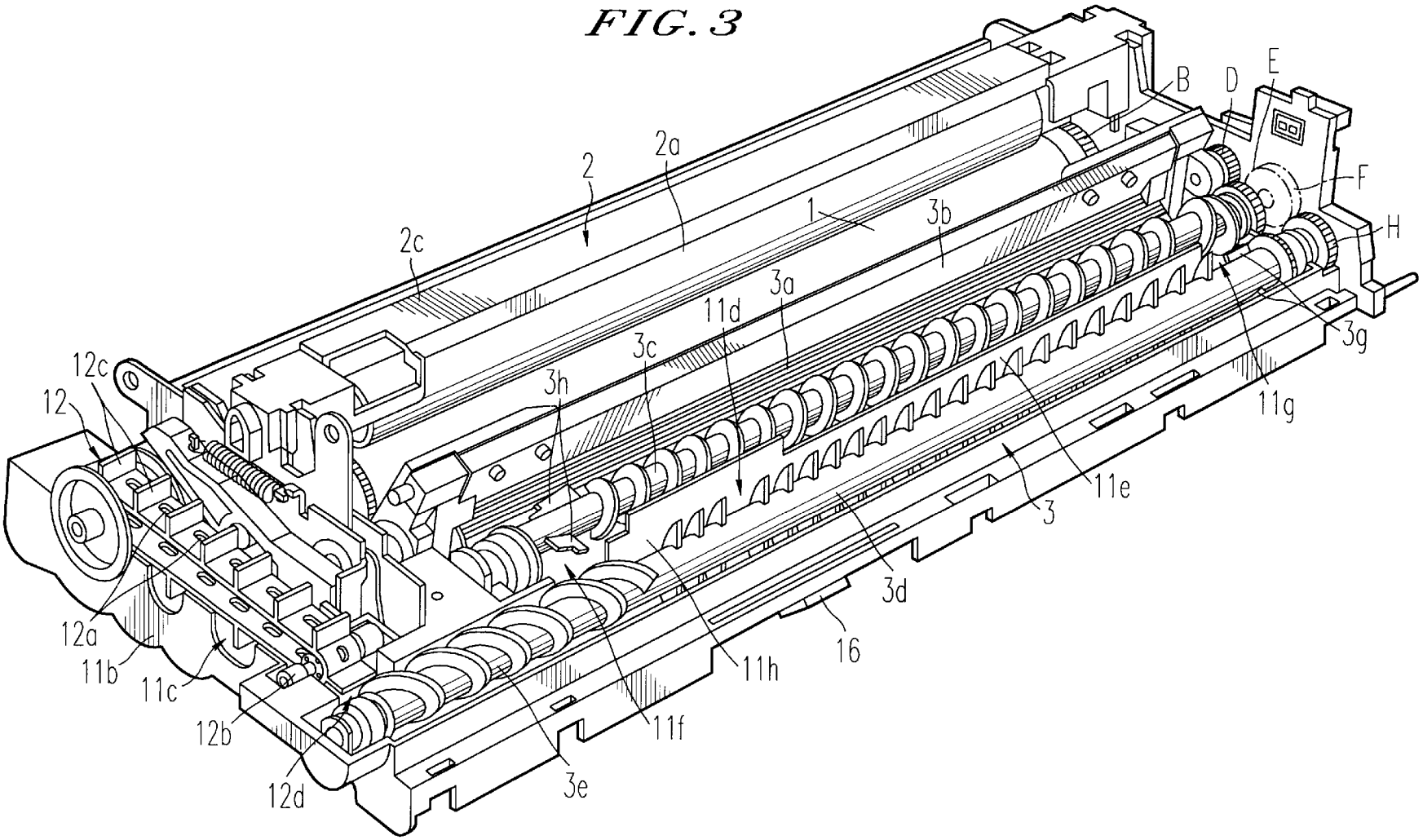
FIG. 3 is a perspective view showing an internal arrangement of the main parts of the image forming device according to the embodiment, where an upper case is removed.
Figure 4:
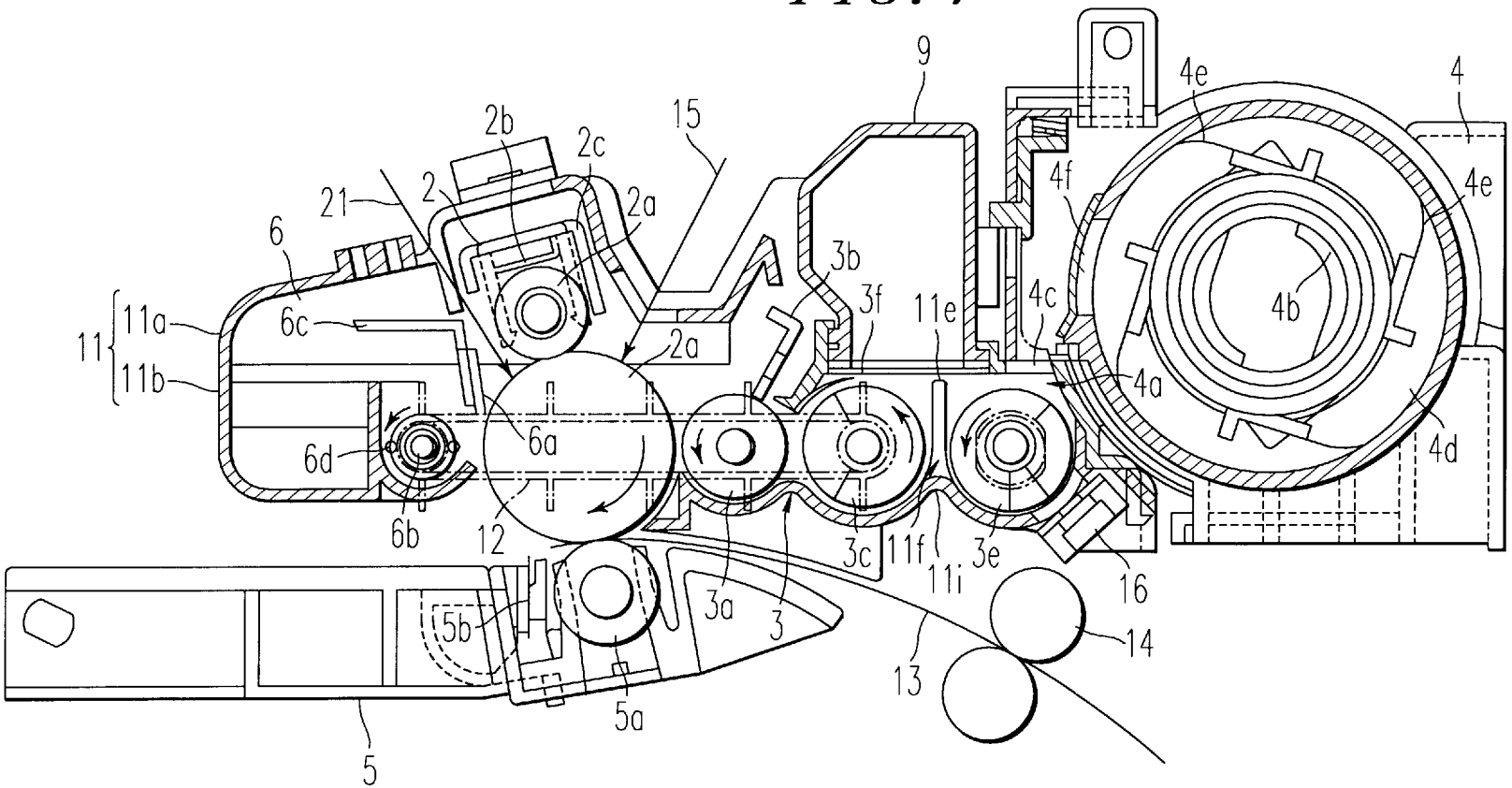
FIG. 4 is a schematic sectional view showing the internal arrangement of the main parts of the image forming device according to the embodiment.
Figure 5:
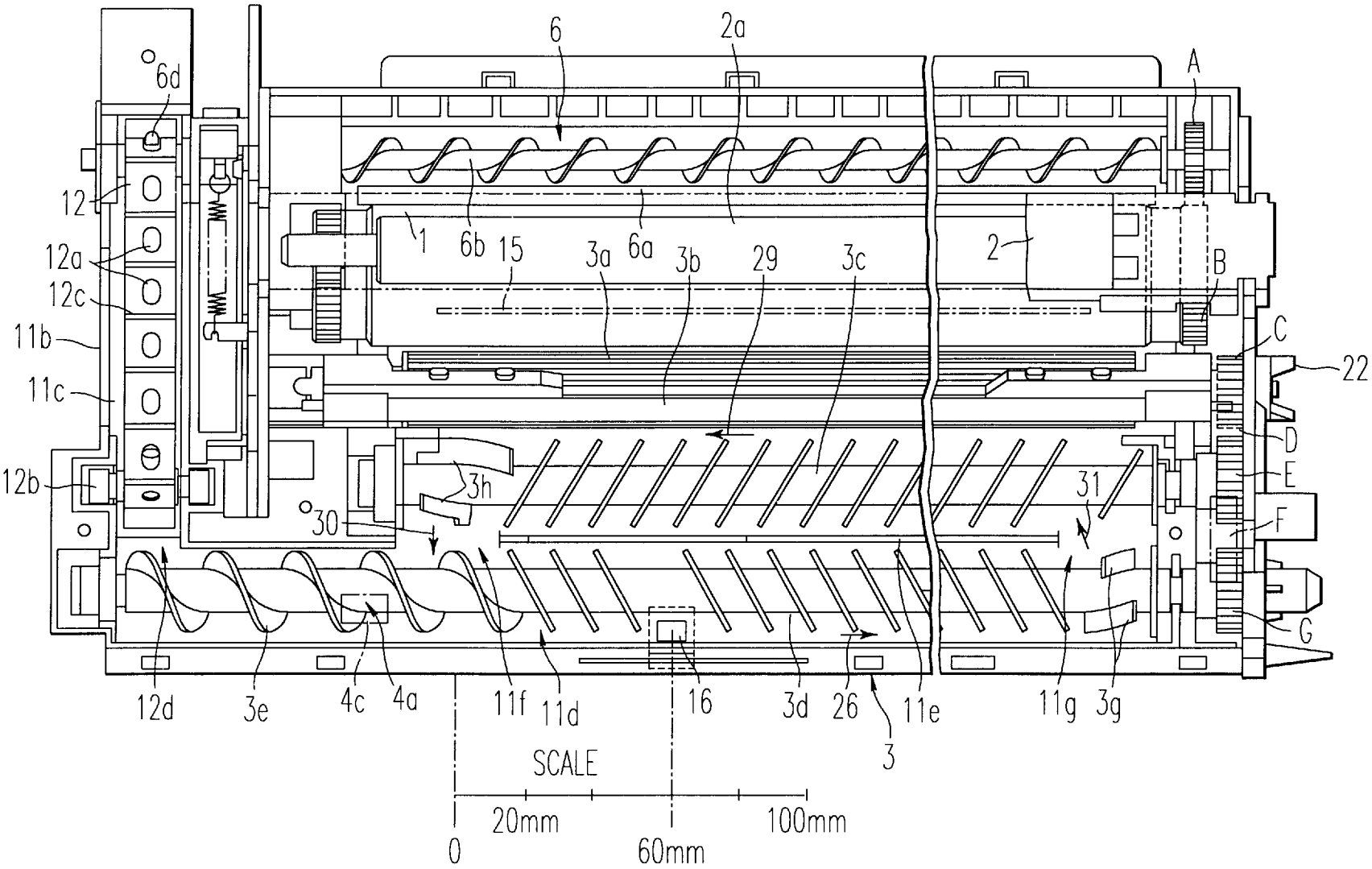
FIG. 5 is a plan view showing the internal arrangement of the main parts of the image forming device according to the embodiment, where the upper case is removed.

Referring now to the drawings, wherein like reference numerals represent identical or corresponding parts throughout the several views, embodiments of the present invention will be described. FIG. 1 is a perspective view of a process cartridge as an example of the main parts of an embodiment of the present invention; FIG. 2 is a perspective view of the process cartridge showing a state where a developer case is removed; FIG. 3 is a perspective view of the process cartridge showing an internal arrangement where the upper case of the process cartridge is removed; FIG. 4 is a sectional view of the process cartridge and other parts near the cartridge, showing the internal arrangement of the process cartridge and the other parts; and FIG. 5 is a top view of the process cartridge where the upper case of the process cartridge is removed. Since the general structure of the process cartridge in FIGS. 1 through 5 is commonly used in all the embodiments described below, the description will be made with respect to the first embodiment and omitted in the other embodiments.

In FIGS. 1 through 5, particularly referring to FIG. 4, a drum-shaped photosensitive body 1 as an image carrier is discharged with a discharging light beam 21 so that the potential on the surface will be leveled off to a reference potential of 0 to −150 V. Then the photosensitive body 1 is charged by a charging roller 2*a* of a charging unit 2 to a surface potential of −1100 V or so. The photosensitive body 1 is exposed to a light beam 15 of an image by an exposure means, not shown, so that the surface potential of a portion, that is, an image portion, where the light beam is irradiated will be leveled to 0 to −290 V. Since a developing sleeve 3*a* as a developer carrier of a developing unit 3 is being biased to −800 V or so, toner particles on the developing sleeve 3*a* adhere to the image portion (electrostatic latent image) on the photosensitive body 1 to form the electrostatic latent image into a toner image.

The photosensitive body 1 on which the toner image is formed is rotated, while a sheet of transfer paper 13 fed by a paper feeder, not shown, is conveyed by a resist roller 14 at such timing so that the leading end of the transfer paper meets the top of the image in a position of a transfer roller 5*a* of a transfer and separation unit 5. The toner image on the photosensitive body 1 is thus transferred to the transfer paper 13. The transfer paper 13 with the transferred toner image is then sent to a fixing unit, not shown, in which the toner image is melted and fixed on the transfer paper 13 by fixing means applying heat and pressure, and the transfer paper 13 is ejected as a copy to a copy receiving tray provided outside of the machine.

The toner remaining on the photosensitive body 1 without being transferred to the transfer paper 13 is scraped off by a cleaning blade 6*a* of a cleaning unit 6 to initialize the photosensitive body 1 for the next image forming process.

The photosensitive body 1, the charging unit 2, the developing unit 3 and the cleaning unit 6 are mounted within a cartridge case 11 of the process cartridge unitarily formed by surrounding the photosensitive body 1. As shown in FIG. 1, the cartridge case 11 includes an upper case 11*a* and a lower case 11*b*.

As shown in FIGS. 4 through 5, the recovered toner that has been removed from the surface of the photosensitive body 1 by the cleaning unit 6 is sent by a toner conveying coil 6*b* to a recycle toner conveying section 11*c* formed at the front side of the cartridge case 11, then conveyed to a developer stirring portion 11*d* of the cartridge case 11 by a recycle belt 12 as a recovered toner conveying member provided in the recycle toner conveying section 11*c*, so that the recovered toner will be reused as recycle toner.

Since the recycle toner conveying section 11*c* is unitarily formed with the cartridge case 11, one does not have to worry about leakage of the toner at the process cartridge in the joint therebetween such as may occur when being formed separately from each other, and therefore any optional element such as a sponge does not need to be provided for preventing leakage of the toner. Further, since sections for arranging respective units are also formed as a body, each unit can be easily incorporated.

The charging roller 2*a* of the charging unit 2 is constructed by wrapping conductive rubber around the outer surface of a metallic core, and is put in contact with the photosensitive body 1 when charging the photosensitive body 1. The charging roller 2*a* may damage the photosensitive body 1 to cause an abnormal image when it is left in contact with the photosensitive body 1 for a long time after the device has stopped. Therefore, the charging unit 2*a* is designed to separate from the photosensitive body when the device stops. On the other hand, the charging roller 2*a* can cause uneven charge on the photosensitive body 1 because the charging roller 2*a* remains in contact with the photosensitive body 1 while charging the photosensitive body 1 and micro-particles of toner foul the surface thereof. To avoid such an inconvenience, a cleaning pad 2*b* for cleaning the surface of the charging roller 2*a* is attached to the charging unit 2 as shown in FIG. 4.

A contact and separation mechanism for the charging roller 2*a* is held by a charging roller case 2*c* through a bearing, not shown. The bearing is movably attached to the charging roller case 2*c* so that the charging roller 2*a* will be pressed on the photosensitive body 1 by a compression spring, not shown, while maintaining a given pressure. The charging roller case 2*c* is pushed up by a compression spring, not shown, so that the cleaning pad 2*b* and the charging roller 2*a* will be lifted up together to separate the charging roller 2*a* from the photosensitive body 1.

The position of the charging roller 2*a* of all three positions, i.e., the operating position in which the charging roller 2*a* contacts and charges the photosensitive body 1, the cleaning position in which the charging roller case 2*c* is pushed down and the cleaning pad 2*b* contacts the charging roller 2*a* or the separate position in which the charging roller case 2*c* is pushed up and the charging roller 2*a* separates from the photosensitive body 1, is determined by the operating position of a charging roller contacting and separating arm, not shown. Then the operating position of the charging roller contacting and separating arm is determined by a contact and separation cam, not shown.

The contact and separation cam is unitarily attached to a rotating shaft of an electromagnetic clutch, not shown, such that the contact and separation cam rotates 120 degrees each time the electromagnetic clutch rotates 120 degrees. Such rotation of the contact and separation cam makes it possible to move the charging roller 2*a* to the above three positions. The use of such a charging roller 2*a* allows a reduction in the amount of produced ozone to 1/100 to 1/1000 compared to a case where a conventional corona charger is used. Accordingly, a member for ozone treatment does not need to be provided.

A two-component developer made of a mixture of toner particles and carrier of small iron balls is stored within the developing casing of the developing unit 3 unitarily formed with the lower case 11*b*. A first developer stirring and conveying member 3*c* and a second developer stirring and conveying member 3*d* arranged along the developing sleeve 3*a* circulate the stored developer in the developing casing while stirring to convey it to the developing sleeve 3*a*. A doctor blade 3*b* as a developer control member is provided close to the outer surface of the developing sleeve 3*a* for controlling the thickness of the developer on the developing sleeve 3*a*.

The doctor blade 3*b* is adjustable in the line normal to the developing sleeve 3*a*. A mechanism for controlling the rotating direction of a magnet inserted into the developing sleeve 3*a* and a supporting member for adjustably supporting the doctor blade 3*b* are provided at one end of the developing sleeve 3*a*. A bearing mechanism for bearing the rotation of the developing sleeve 3*a* and a supporting member with a bearing fitted thereinto under pressure for adjustably supporting the doctor blade 3*b* are also provided at the other end of the developing sleeve 3*a*. The doctor blade 3*b* is moved along the normal line of the developing sleeve 3*a* by adjusting the above supporting members so that a gap between the doctor blade 3*b* and the developing blade 3*a* and hence the thickness of the developer on the developing sleeve will be controlled. The gap between the doctor blade 3*b* and the developing sleeve 3*a* can be controllable from the outside of the developing unit 3.

A portion of the outer surface of the developing sleeve 3*a* that faces the photosensitive body 1 is exposed from the developing casing. An unillustrated entrance seal, made of Mylar or the like, is provided along the longitudinal direction of the exposed portion and upstream in the rotating direction of the developing sleeve 3*a* for preventing toner particles from scattering to the outside of the developing casing. Side seals, not shown, are also provided at front and back ends of the exposed portion, respectively, for preventing toner particles from scattering through the ends.

The developing sleeve 3*a* is formed into a rotatable aluminum cylinder having a diameter of 16 to 20 mm. The cylinder has a flat surface, or a wave-like surface with V-shaped grooves or the like for carrying more developer. Five magnets are so arranged in the developing sleeve 3*a* so that they never rotate along the circumferential direction of the internal surface and a given distribution of magnetic force appears in the normal direction.

In FIG. 4, the transfer roller 5*a* of the transfer and separation unit 5 is formed by wrapping conductive resin on a metallic core and is pressed by an unillustrated compression spring against the photosensitive body 1 together with its bearing. The transfer roller 5*a* is supplied with constant current to transfer a toner image on the photosensitive body 1 to the transfer paper 13. The transfer roller 5*a* is able to move into contact with or away from the photosensitive body 1 in the same manner as the charging roller 2*a*. A discharge needle 5*b* is also arranged at the lower stream side of the transfer roller 5*a*. The discharge needle 5*b* is made of a thin metallic plate and the tip thereof directed to the photosensitive body 1 is formed into a sharp and pointed saw-tooth like shape. The discharge needle 5*b* is applied with a voltage from a power source, not shown, to remove electrostatic charge from the transfer paper 13 on purpose to assist separation of the transfer paper 13 from the photosensitive body 1.

As shown in FIGS. 1 and 4, a developer case 9 is provided to the upper case 11*a* of the cartridge case 11. The developer case 9 is removably attached to the upper case 11*a* of the cartridge case 11 and, as shown in FIGS. 2 and 4, the upper case 11*a* is provided with a developer intake port 3*f* in a position where the developer case 9 is attached to the upper case 11*a*. An opening is also provided in the lower portion of the developer case 9. The opening of the developer case 9 is sealed with a seal material, not shown, when the developer case 9 is assembled, after storing a given amount of premixed developer (where toner and carrier are premixed in a given ratio) into the developer case 9. The seal material is to prevent the developer enclosed within the developer case 9 from falling into the developing unit 3 during shipment and delivery, and from coagulating due to moisture absorption while the process cartridge is being stored before shipment. The seal material is removed from the opening in use of the process cartridge.

The developer case 9 is set in the upper case 11*a* of the process cartridge body in the condition that the opening is sealed with the seal material. Then the seal material is removed from the opening manually or automatically to release the opening of the developer case 9 on condition that the developer case 9 has been set in the process cartridge body. The developer enclosed within the developer case 9 falls under gravity and fills the developing unit 3 therewith to set the developing unit 3 to an initial state where development can start.

On the other hand, the cleaning blade 6*a* of the cleaning unit 6 is made of a polyurethane rubber flat plate and fixed to a metallic blade holder 6*c* with adhesive or double-sided tape. The blade holder 6*c* is put in a position parallel to an inclined plane of a case part formed around the photosensitive body 1 under control of two positioning pins provided on the inclined plane, and fixed to the case part around the photosensitive body by fastening screws in a direction opposite to the rotating direction of the photosensitive body 1, i.e., in a counter direction. The screws are so positioned to the sticking surface of the cleaning blade 6*a* that the blade holder 6*c* is brought into full contact with the inclined plane of the case part formed around the photosensitive body and inclined along the inclined plane. Thus the vertical direction of the cleaning blade 6*a* is controlled to the inclined plane.

As discussed above, a desired contact angle and intensity of pressure to the photosensitive body 1 are secured perfectly to prevent the occurrence of a cleaning failure or a generation of noise. In such a case construction around the photosensitive body, the thrust positions of the screws are preferably put externally from both ends including a flange of the photosensitive body 1 on purpose to replace only the cleaning blade 6*a* without removing the photosensitive body 1.

The recovered toner that is scraped from the photosensitive body 1 by the cleaning blade 6*a* is conveyed to the front side (left side in FIG. 5) of the cartridge case 11 by the toner conveying screw 6*b* of the cleaning unit 6. The toner conveying screw 6*b* is provided with a gear A at the back side of the cartridge case 11, and the gear A is put in a hole D at the back side of the cartridge case 11 and engaged with a gear B unitarily formed with the flange of the photosensitive body 1 so that the rotation of the gear B driven to rotate by an external input from a drive motor or the like is transmitted thereto.

As shown in FIG. 5, a gear C located at the back side of the developing sleeve 3*a* is driven to rotate by an external input from a drive motor or the like through a coupling 22. The rotation of the gear C is transmitted through an idle gear D to a gear E located at the back side of the first developer stirring and conveying member 3*c*, then the rotation of the gear E is transmitted through an idle gear F to a gear H located at the back side of the second developer stirring and conveying member 3*d* (FIG. 3). The developing sleeve 3*a*, the first developer stirring and conveying member 3*c*, the second developer stirring and conveying member 3*d* and the toner conveying screw 6*b*, arranged around the photosensitive body 1, thus rotate in directions indicated by arrows in FIG. 4, respectively. Since an identical driving power source is used for conveying the toner in the cleaning unit and driving the photosensitive body to rotate, both are synchronized with each other. The elements of the developing unit 3 are driven by the driving power source through a clutch and this allows a changeover between driving state and non-driving state. All the elements of the developing unit 3 are driven together through respective gears. There is also provided a mechanism, not shown, for detecting current flowing through the driving power source to stop the driving of the driving power source when any factor causes the locking of a member such as the developer stirring and conveying member.

Although the first developer stirring and conveying member 3*c* and the second developer stirring and conveying member 3*d* rotate in the directions indicated by the respective arrows in FIG. 4 in the embodiment, such rotating directions are not limited by the embodiment and both members may rotate in directions opposite to the arrows in FIG. 4, respectively, or they may rotate in the same direction, by changing the number of idle gears or rearranging the idle gears. When the rotating directions of the first developer stirring and conveying member 3*c* and the second developer stirring and conveying member 3*d* are set to be opposite to the arrows in FIG. 4, respectively, the inclined angle of the fins and the thread cutting direction of the screw must be set oppositely, described later in detail, to prevent the developer from circulating and conveying in the opposite direction.

As shown in FIG. 5, a pin 6*d* is provided in front of the toner conveying screw 6*b* to be put into an elongated hole 12*a* provided on a toner recycling belt 12 as a recycle toner delivering member to drive the toner recycling belt 12. The other end of the toner recycling belt 12 is supported by the belt-driven roller 12*b* rotatably put in a prescribed position by the lower case 11*b* of the developing unit 3 to give given tension to the toner recycling belt 12.

The recovered toner conveyed by the toner conveying screw 6*b* from the cleaning unit 6 passes through the elongated holes of the toner recycling belt 12 while unstably moving near the toner receiving portion for delivering the recovered toner to the recycling belt 12. Then, fins 12*c* provided on the toner recycling belt 12 conveys the recovered toner as recycle toner to a recycle toner receiving portion 12*d* through which the recycle toner is sent to a screw member 3*e* as a toner conveying member unitarily formed with the second developer stirring and conveying member 3*d* of the developing unit 3.

As shown in FIG. 4, there is provided a toner concentration sensor 16 as a toner concentration detecting member, constructed by a magnetic permeability measuring sensor, for detecting the toner concentration (ratio between carrier and toner) in the developer enclosed within the developing casing. When the toner concentration in the developer is a reference value or lower, a desired amount of new toner is replenished, on the basis of the detection signal from the toner concentration sensor 16, from a toner bottle 4*b* of a toner replenishing unit 4 as a new toner replenishing member through a toner replenishing port 4*c* as a toner replenishing portion to a toner replenishing portion 4*a* provided above the screw member 3*e* penetrating the toner conveying path that communicates with the developer stirring and conveying path (developer stirring portion 11*d*) provided in front of the developing unit 3 (see FIGS. 6 and 7). When low toner concentration is detected by the toner concentration sensor 16 in this detection system, a period of time to replenish toner is determined, and the amount of toner to be replenished is finally determined on the basis of the determined period time to replenish toner and the size of transfer paper 13 fed by the paper feeder. Such detection starts when starting the development process (when starting the drive of the developing roller), detects the toner concentration in a given manner during the development process and determines the detected value.

When the toner concentration in the developer becomes a reference value or lower, the toner concentration sensor 16 detects such toner concentration in the developer, and then, an electromagnetic clutch, not shown, of a bottle driving shaft for rotating the toner bottle 4*b* of the toner replenishing unit 4 is turned on by the detection signal from the toner concentration sensor 16, whereby the toner bottle 4*b* rotates to replenish a desired amount of toner through the toner replenishing port 4*c* to the toner replenishing portion 4*a* provided in front of the developing unit 3.

The toner bottle 4*b* has a spiral projection therein so that the toner can be sent from the back side to the toner outlet on the front side sequentially along with the rotation of the bottle driving shaft. Since the amount of toner to be discharged from the toner bottle 4*b* is not constant, the replenished toner is temporarily stored in a toner reservoir 4*d* formed in the end portion of the toner replenishing unit 4.

The toner reservoir 4*d* serves as a buffer, where the replenished toner stored in the toner reservoir 4*d* is replenished by a small and constant amount through small holes (with a diameter of 0.5 to 1 mm) of a Mylar 4*f*, provided between the toner reservoir 4*d* and the toner replenishing port 4*c*, each time a replenishing shaft of a toner replenishing Mylar 4*e* rotates. Then the constant amount of replenished toner is replenished from the toner replenishing port 4*c* to the toner replenishing portion 4*a* located above the screw member 3*e*. Specifically, about 0.6 grams of toner will be replenished into the developing unit 3 each time 10 to 15 copies of an A4 size original with an image area of 5 to 6% of A4 size are taken.

As shown in FIGS. 3 and 5, a partition 11*e* unitarily formed with the developing casing (lower case 11*b*) is provided between the developer circulating path of the first developer stirring and conveying member 3*c* and the developer circulating path of the second developer stirring and conveying member 3*d*, with connecting ports 11*f* and 11*g* provided at the front and back sides of the partition 11*e*, respectively, for use as a receiving portion between the developer circulating path of the first developer stirring and conveying member 3*c* and the developer circulating path of the second developer stirring and conveying member 3*d*. The developer that has been conveyed to the back side (in the direction of arrow 26) by the second developer stirring and conveying member 3*d* is struck on rectangular vanes 3*g* provided at the back side of the second developer stirring and conveying member 3*d* to change its flowing direction toward a direction of an arrow 31. Then the developer is sent along the direction of the arrow 31 into the developer circulating path of the first developer stirring and conveying member 3*c* through the back-side connecting port 11*g*.

The developer that has been sent from the back-side connecting port 11*g* after being conveyed by the second developer stirring and conveying member 3*d* is stirred and conveyed to the front side in the direction of an arrow 29 in FIG. 5 by the first developer stirring and conveying member 3*c*. The first developer stirring and conveying member 3*c* recovers or supplies developer from or to the developing sleeve 3*a* while stirring and conveying the developer. The developer strikes rectangular vanes 3*h* provided at the front side of the first developer stirring and conveying member 3*c* and changes its flowing direction toward a direction indicated by an arrow 30. Then the developer is sent along the direction of the arrow 30 into the developer circulating path of the second developer stirring and conveying member 3*d* through the front-side connecting port 11*f*. The two-component developer made of a mixture of carrier and toner, stored within the casing of the developing unit 3 unitarily formed with the lower case 11*b*, is thus circulated and conveyed while being stirred within the developing casing, and finally supplied to the developing sleeve 3*a*.

If the developer circulating paths are sealed up, toner particles the specific gravity of which is lighter than that of the carrier grains may be sprayed as a jet flow owing to a pumping effect of the rotation of the first developer stirring and conveying member 3*c* and the second developer stirring and conveying member 3*d*. To eliminate such an inconvenient problem, the partition 11*e* between the developer circulating path of the first developer stirring and conveying member 3*c* and the developer circulating path of the second developer stirring and conveying member 3*d* is so formed that a gap is kept between the partition 11*e* and the upper case 11*a*.

The gap between the partition 11*e* and the upper case 11*a*, however, may cause an overflow of the developer through the gap. When the developer is overflown from the developer circulating path located in the upper stream of the toner concentration sensor 16, the overflown developer is circulated through a short-circuited path, and therefore the toner concentration detected by the toner concentration sensor 16 exhibits an inaccurate value. As a result, the toner concentration in the developer that is circulated in the regular path becomes uneven.

When the developer is overflown from the developer circulating path of the second developer stirring and conveying member 3*d* to the developer circulating path of the first developer stirring and conveying member 3*c*, the developer having high toner concentration due to less toner consumption is circulated through a short-circuited path located in the upper stream of the toner concentration sensor 16, and therefore the toner concentration in the developer that is circulated in the regular path becomes exhausted. Conversely, when the developer is overflown from the developer circulating path of the first developer stirring and conveying member 3*c* to the developer circulating path of the second developer stirring and conveying member 3*d*, the developer having low toner concentration due to consumed toner is circulated through a short-circuited path located in the upper stream of the toner concentration sensor 16, and therefore the toner concentration in the developer that is circulated in the regular path is rather more than necessary.

In the embodiment, the height of the partition 11*e* is made different such that a portion 11*h* located in the upper stream of the toner concentration sensor 16 is higher than the other portions, as shown in FIG. 3, on purpose to prevent an overflow of the developer in the developer circulating path located in the upper stream of the toner concentration sensor 16. The toner concentration sensor 16 preferably detects the toner concentration in the developer that has been supplied with replenished toner at an earlier stage. Therefore, as shown in FIGS. 1 through 5, in the embodiment the toner concentration sensor 16 is arranged in a position about 50 mm downstream of the upper-stream connecting port 11*f*. Although the second developer stirring and conveying member 3*d* is constructed with a plurality of elliptic fins slantingly arranged, there is no elliptic fin in a section corresponding to a detecting position of the toner concentration sensor 16, as shown in FIGS. 3 and 5, on purpose to prevent a ripple of the toner concentration signal caused by rotation of the fins. This makes it possible to accumulate the developer in the detecting position and hence to detect the toner concentration properly. Since such a section is provided for accumulating the developer to prevent deviation of the detection, the same results can be obtained by arranging elliptic plates smaller than the other in the section, or widening the distance between the plates.

The recycle toner conveyed by the recycling belt 12 to the recycle toner receiving portion 12*d* is the used recovered-toner that has been removed from the photosensitive body 1 by means of the cleaning blade 6*a*, and the recovered toner is fairly condensed compared to new toner replenished from the toner bottle 4*b* of the toner replenishing unit 4 to the toner replenishing portion 4*a* through the toner replenishing port 4*c* because the recovered toner is circulated and conveyed in the condition that it is pushed into the screw member 3*e* as a toner conveying member by the toner conveying coil 6*b* and the recycling belt 12 as a recovered toner conveying member. It is therefore difficult to mix such condensed recycle toner with the carrier in the two-component developer and hence to charge the recycle toner.

When the condensed recovered-toner is reused as the recycle toner as it is, the dispersion of the recovered-toner is not enough and hence the charge of the toner is unstable, which causes smudges on the background of an image. Such tendency is remarkable in a compact image forming device incapable of making the developer stirring and conveying path long such as the process cartridge or photosensitive body unit.

Figure 8B:
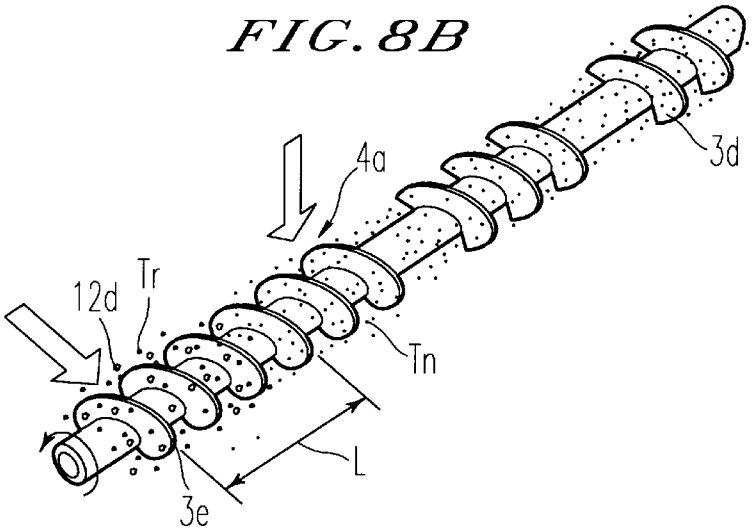
FIG. 8(*a*) is a schematic perspective view showing conveying states of recycle toner in a conventional image forming device.
Figure 8A:
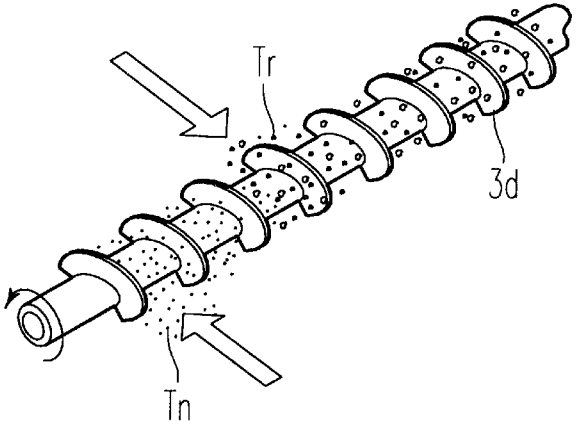
FIG. 8A PRIOR ART

As shown in FIG. 8(*a*), in related process cartridges, recycle toner Tr is reused by directly delivering it to the second developer stirring and conveying member 3*d* arranged with a plurality of fins each formed by notching part of an elliptic plate. Since the condensed recycle toner Tr having relatively big particles is conveyed into the developer without being dispersed finely, the dispersion of the condensed recycle toner Tr into the developer is not enough and hence the charge of the recycle toner Tr is unstable. Therefore, a problem arises that smudges on the background of an image occurs.

Figure 6:
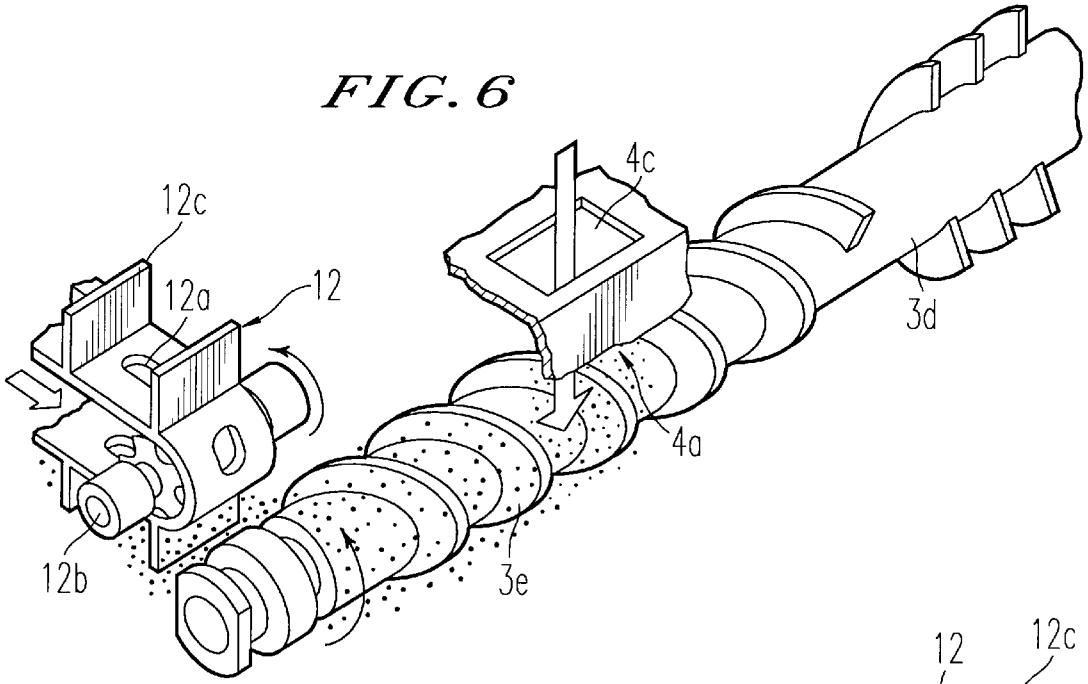
FIG. 6 is a perspective view of the main parts of a toner conveying member unitarily formed with a developer stirring and conveying member according to the embodiment, which shows the positional relationship between a new toner replenishing portion and a recycle toner receiving portion.
Figure 7:
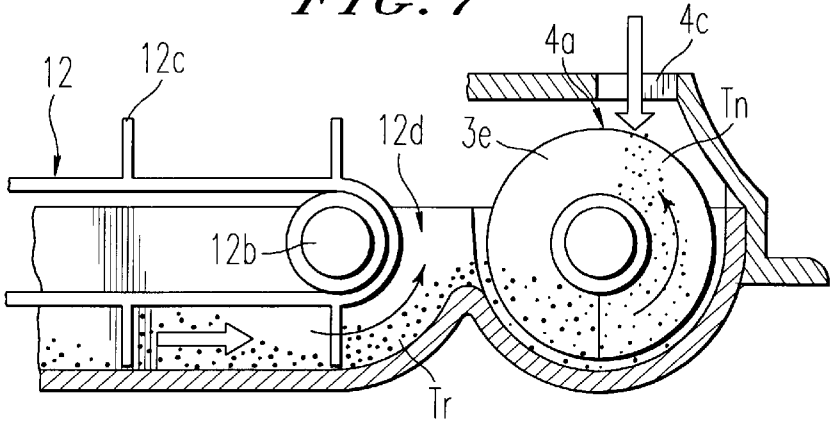
FIG. 7 is a schematic sectional view of the toner conveying member unitarily formed with the developer stirring and conveying member according to the embodiment, which shows the positional relationship between the new toner replenishing portion and the recycle toner receiving portion.

In the process cartridge of the embodiment, as shown in FIGS. 5 through 7, the recovered toner that has been removed from the photosensitive body 1 is conveyed to the upstream of the toner replenishing portion 4*a* (new toner replenishing portion) of the toner conveying path that communicates with the developer stirring and conveying path of the second developer stirring and conveying member 3*d* for stirring and conveying the developer to the developing sleeve 3*a* developing an electrostatic latent image on the photosensitive body 1. Stated more particularly, the embodiment features that the recycle toner receiving portion 12*d* for the recycle toner conveyed by the recycling belt 12 as a recovered toner carrying member is provided in the upper stream of the toner replenishing portion 4*a*, and the screw member 3*e* as a toner conveying member and the second developer stirring and conveying member 3*d* are formed as a body.

That is, in the process cartridge of the embodiment, the recycle toner conveyed by the recycling belt 12 is received from the toner receiving portion 12*d* that is provided at the upstream side of the toner replenishing portion 4*a* of the screw member 3*e* with a spiral fin that is unitarily formed with the second developer stirring and conveying member 3*d* for stirring and conveying the developer.

By receiving the recycle toner upstream of the toner replenishing portion 4*a* of the screw member 3*e*, a fixed distance L between the recycle toner receiving portion 12*d* and the toner replenishing portion 4*a* for new toner (replenished toner) Tn can be secured as shown in FIG. 8(*b*). Since the condensed recycle toner Tr is dispersed thinly and mixed with the new toner Tn replenished from the toner replenishing portion 4*a*, then stirred and conveyed together with the developer by the second developer stirring and conveying member 3*d*, the recycle toner Tr can be charged smoothly.

Next, another embodiment will be described. In this embodiment, the first developer stirring and conveying member 3*c* and the second developer stirring and conveying member 3*d* are each constructed by an elliptic fin member having a plurality of stirring fins 3*i* (FIG. 9) each formed by notching part of an elliptic plate and slantingly arranged, such that the developer can be stirred enough to charge the toner while conveying the developer at a relatively low speed. Since developer conveying speed is relatively slow in such an image forming device of the embodiment, it is easy to accumulate the developer near the developer receiving portion (connecting port 11*f*).

In this type of image forming device, the developer accumulated near the developer receiving portion (connecting port 11*f*) may cause a backflow of the developer into the toner replenishing path. In conventional image forming devices, toner to be replenished from the toner replenisher is fed to the second developer stirring and conveying member 3*d* through the toner conveying means provided separately from the second developer stirring and conveying member 3*d*, and the developer near the developer receiving portion (connecting port 11*f*) that communicates with the downstream of the developer circulating path of the first developer stirring and conveying member 3*c* is relatively heavy with a large amount of carrier due to toner consumption, so that the toner replenished to the second developer stirring and conveying member 3*d* is dispersed into the developer slowly. In this case, the toner concentration in the toner concentration detecting position reaches a reference value very slowly even after a required amount of toner has been replenished, resulting in excess toner replenishment.

Such an inconvenient problem remarkably appears in a compact image forming device incapable of making the developer stirring and conveying path long such as the process cartridge of the embodiment, in which image forming units such as a developing unit and a cleaning station arranged around the photosensitive body are unitarily formed with the photosensitive body, because the developer needs to be conveyed more slowly so that the toner can be charged sufficiently.

Figure 9:
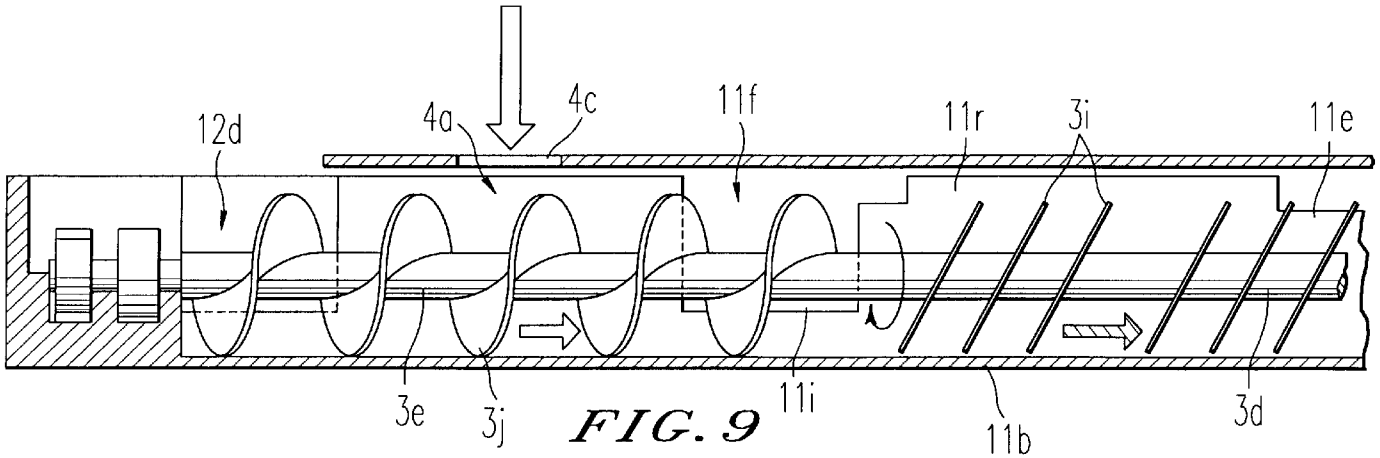
FIG. 9 is a sectional view of the toner conveying member unitarily formed with the developer stirring and conveying member according to the embodiment, which shows the positional relationship between a developer receiving portion and a toner replenishing portion.

As shown in FIGS. 5 and 9, the present invention therefore features that the toner conveying member for conveying the replenished toner, fed from the toner replenisher to the toner replenishing portion 4*a* through the toner replenishing port 4*c*, toward the second developer stirring and conveying member 3*d*, is constructed by the screw member 3*e* with a spiral conveying fin 3*j* capable of conveying the replenished toner at relatively high speed. The screw member 3*e* is formed unitarily with the second developer stirring and conveying member 3*d*. The present invention also features that the replenished toner is delivered through the toner replenishing portion 4*a* provided in the upper stream of the developer receiving portion (connecting port 11*f*) of the screw member 3*e*.

The replenished toner delivered through the toner replenishing portion 4*a* provided in the upper stream of the developer receiving portion (connecting port 11*f*) of the screw member 3*e* unitarily formed with the second developer stirring and conveying member 3*d* is then conveyed by the screw member 3*e* at a speed higher than the developer conveying speed of the second developer stirring and conveying member 3*d*, thereby conveying the replenished toner quickly to the developer circulating path of the second developer stirring and conveying member 3*d*.

Further, according to the present invention, the developer delivered from the first developer stirring and conveying member 3*c* to the second developer stirring and conveying member 3*d* through the connecting port 11*f* can be compulsively pushed by the screw member 3*e* into the developer circulating path of the second stirring and conveying member 3*d*, thereby preventing a backflow of the developer into the toner replenishing path due to accumulation of the developer near the developer receiving portion (connecting port 11*f*) that may cause excess toner replenishment. In the embodiment, the toner replenished through the toner replenishing port 4*c* is delivered through the toner replenishing portion 4*a* provided upstream of the developer receiving portion (connecting port 11*f*) of the screw member 3*e*, so that a distance from the toner replenishing portion 4*a* to the detecting position of the toner concentration sensor 16, i.e., time after the toner replenishment until the toner concentration is detected can be set shorter. It is also possible to quickly disperse the replenished toner into the developer stirred and conveyed by the second developer stirring and conveying member 3*d*.

Since 1% silica is added as an additive to the toner in the developer, the fluidity of the developer can increase and, even when using a stirring and conveying member with elliptic plates the fluidity by which is lower than the screw member, the fluidity substantially equal to that by the screw member can be obtained. The first developer stirring and conveying member 3*c* and the second developer stirring and conveying member 3*d* have excellent stirring properties compared to the screw member 3*e*, which can solve both the problems of stirring and conveying properties. By using such a stirring and conveying member with elliptic plates, sufficient stirring and conveying performance can be attained even in a compact image forming device, and hence an amount of electrostatic charge (Q/M) of the developer needed for development can be obtained. The amount of electrostatic charge of silica becomes small at high temperature and humidity, but becomes excessive at low temperature and humidity. To avoid such problems, 0.3% titanium oxide, in addition to 0.7% silica, can be added to increase the environmental stability of the developer.

Figure 10A:
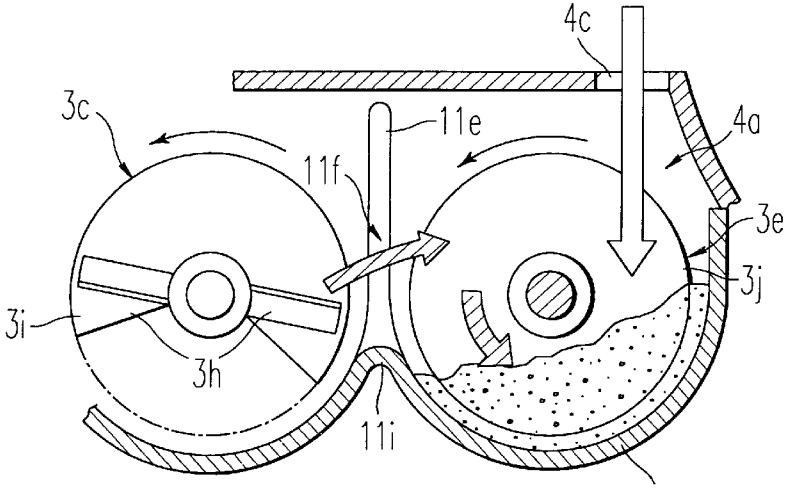
FIG. 10(*a*) is a sectional view showing a structure of a developer receiving portion according to another embodiment of the present invention, where a screw member as a toner delivering member rotates in a counter-clockwise direction.
Figure 10B:
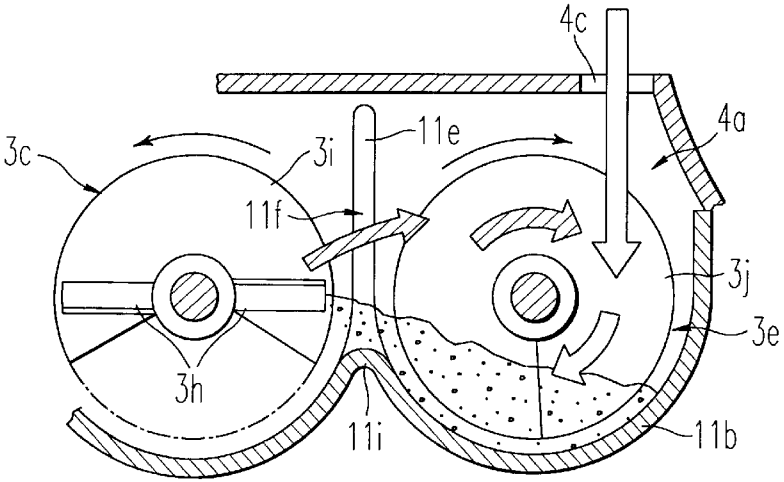

Next, a further embodiment will be described. In this embodiment, a chevron-like protrusion 11*i* is formed, as shown in FIGS. 10(*a*) and 10(*b*), on the bottom of the connecting port 11*f* of the developer receiving portion through which the developer circulating path of the first developer stirring and conveying member 3*c* and the developer circulating path of the second developer stirring and conveying member 3*d* are connected, i.e., it is formed on the bottom of the developer conveying portion located at the lowermost-stream side of the first developer stirring and conveying member 3*c*. Therefore, the developer passing through the connecting port 11*f* of the developer receiving portion after being conveyed by the first developer stirring and conveying member 3*c* can be delivered from the upside of the toner conveying path of the screw member 3*e* (or the developer circulating path of the second developer stirring and conveying member 3*d*), as shown by hatched arrows in FIGS. 10(*a*) and 10(*b*), thereby accelerating the diffusion of the replenished toner into the developer.

As previously described, the developer passing through the connecting port 11*f* of the developer receiving portion after being conveyed by the first developer stirring and conveying member 3*c* is relatively heavy with a large amount of carrier due to toner consumption. In contrast, the toner replenished to the toner conveying path of the screw member 3*e* through the toner replenishing port 4*c* is fairly lighter than the developer containing the carrier, and tends to move the upper side of the developer due to various factors such as vibration from the outside.

In the embodiment, the chevron-like protrusion 11*i* is formed on the bottom of the connecting port 11*f* of the developer receiving portion so that the developer passing through the connecting port 11*f* of the developer receiving portion after being conveyed by the first developer stirring and conveying member 3*c* will be delivered from the upper side to the toner replenished within the toner conveying path of the screw member 3*e*. Since the light replenished toner is covered with the heavy developer at the time of delivery, the diffusion of the replenished toner into the developer can be accelerated.

As shown in FIG. 10(*a*), the rotating direction of the first developer stirring and conveying member 3*c* is preferably set to the counterclockwise direction. In FIG. 10(*a*), when the first developer stirring and conveying member 3*c* rotates in the counterclockwise direction, the developer within the developer circulating path of the first developer stirring and conveying member 3*c* is delivered from the upside of the toner conveying path of the screw member 3*e* through the connecting port 11*f*, as shown by the hatched arrows in FIG.

10(*a*), while it is scooped up along the protrusion 11*i* by the vanes 3*h* provided at the front side (left side in FIG. 5) of the first developer stirring and conveying member 3*c*. This makes it possible to further accelerate the diffusion of the replenished toner into the developer.

The vanes 3*h* provided at the front side of the first developer stirring and conveying member 3*c* are inclined in a direction to cause such a conveying force as the developer to be conveyed to the front side by the stirring fins 3*i* is pushed back to the back side by the rotation of the vanes 3*h*. Such a conveying force allows changing the developer conveying direction of the first developer stirring and conveying member 3*c* to a direction substantially perpendicular to the connecting port 11*f* through which the developer is delivered to the screw member 3*e* (or second developer stirring and conveying member 3*d*). This makes it possible to deliver the developer from the upside of the toner conveying path of the screw member 3*e* more securely by means of the vanes 3*h*, and hence to accelerate the diffusion of the replenished toner into the developer. This also makes it possible to prevent a backflow of the developer into the upper stream of the toner conveying path of the screw member 3*e* or the developer from breaking into the bearing portion located at the front side of the first developer stirring and conveying member 3*c*. As is similar to the vanes 3*h*, the vanes 3*g* provided at the back side of the second developer stirring and conveying member 3*d* are inclined in a direction to cause such a conveying force as the developer to be conveyed to the back side by the stirring fins 3*i* is pushed back to the front side by the rotation of the vanes 3*g*.

As shown in FIG. 10(*a*), the rotating direction of the screw 3*e* (second developer stirring and conveying member 3*d*) is set in the embodiment to the counterclockwise direction. Therefore, the developer delivered from the first developer stirring and conveying member 3*c* through the connecting port 11*f* can be taken quickly into the toner conveying path of the screw member 3*e*, thus preventing the developer from accumulating near the connecting port 11*f* more securely. However, as shown in FIG. 10(*b*), even when the screw member 3*e* rotates in the clockwise direction, the developer can be delivered to the replenished toner within the toner conveying path of the screw member 3*e* from the upside of the screw member 3*e* to the both sides of the rotation axis thereof. This also makes it possible to accelerate the diffusion of the replenished toner into the developer.

Figure 11A:
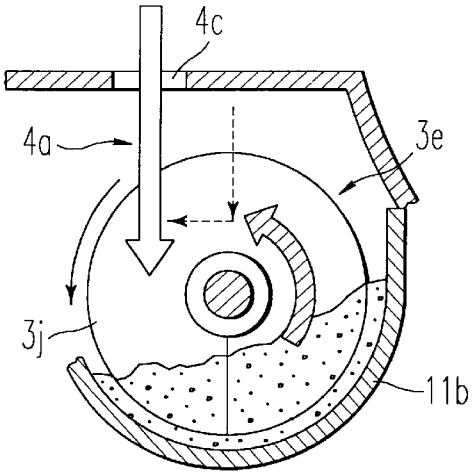
FIG. 11(*a*) is a sectional view showing a structure of a toner replenishing portion according to another embodiment of the present invention, where a screw member as a toner delivering member rotates in a counter-clockwise direction.
Figure 11B:
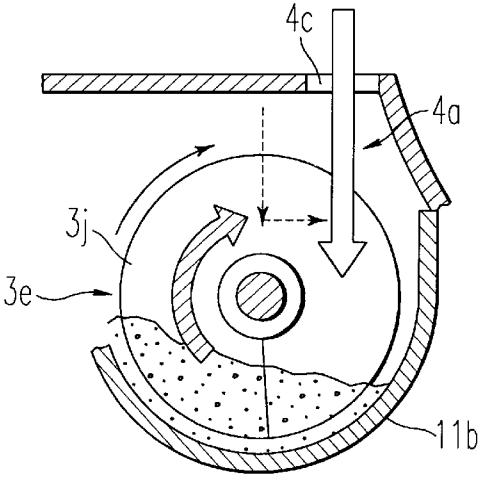

Next, a further embodiment will be described. In this embodiment, the toner receiving portion of the screw member 3*e* for receiving the toner replenished from the toner replenishing portion 4*a* through the toner replenishing port 4*c* is put in a position deviated from the rotation axis of the screw member 3*e* as shown in FIGS. 11(*a*) and 11(*b*). Such a position of the toner receiving portion allows an accelerated intake of the replenished toner to the developer and prevents a scattering of the replenished toner.

If the toner receiving portion of the screw member 3*e* is located right above the rotation axis of the screw member 3*e*, the rotation axis will prevent the replenished toner from falling into the developer, and therefore the replenished toner is taken into the developer slowly. Further, as shown by the broken arrows in FIGS. 11(*a*) and 11(*b*), since the tangent to a locus of rotation of the conveying fin 3*j* of the screw member 3*e*, which touches the locus at a point located right below the toner receiving portion, intersects the falling direction of the replenished toner substantially at right angles, the replenished toner particles falling on the conveying fin 3*j* are reflected back to the side. The replenished toner reflected to the side could be scattered and suspended in the air because the replenished toner is very light as discussed above.

In contrast, when the receiving portion of the replenished toner is put in a position deviated from the rotation axis of the screw member 3*e* as in the embodiment, the rotation axis does not prevent the replenished toner from falling into the developer and intake of the replenished toner to the developer is accelerated. Further, as shown by the arrows with blanks in FIGS. 11(*a*) and 11(*b*), since the tangent to the locus of rotation of the conveying fin 3*j* of the screw member 3*e*, which touches the locus at a point located right below the toner receiving portion, is substantially in parallel to the falling direction of the replenished toner, the replenished toner particles falling on the conveying fin 3*j* are not reflected back to the side, and the replenished toner is not scattered.

The rotating direction of the screw member 3*e* in which the replenished toner is received is the same as the replenishing direction of the toner replenished from the toner replenisher. Such a rotating direction prevents scattering of the replenished toner and makes it possible to further accelerate intake of the replenished toner to the developer.

Since the rotating direction of the screw member 3*e* in which the replenished toner is received is the same as the replenishing direction of the toner, as shown in FIGS. 11(*a*) and 11(*b*), the tangent to the locus of rotation of the conveying fin 3*j* of the screw member 3*e*, which touches the locus at a point located right below the toner receiving portion, is directed to the same direction as the falling direction of the toner replenished from the toner replenishing port 4*c*. Therefore, the toner replenished from the toner replenishing port 4*c* can be taken in quickly to the bottom side of the toner conveying path of the screw member 3*e* to prevent scattering of the replenished toner. This also makes it possible to accelerate intake of the replenished toner to the developer.

As shown in FIG. 11(*a*), the rotating direction of the screw member 3*e* (second developer stirring and conveying member 3*d*) is set in the embodiment to the counterclockwise direction in the same manner as in the above embodiment. In this case, the toner replenishing port 4*c* is provided such that the replenished toner receiving portion of the conveying fin 3*j* is put in a position which is deviated to the left of the rotation axis of the screw member 3*e*. As shown in FIG. 11(*b*), when the rotating direction is set to the clockwise direction, the toner replenishing port 4*c* is provided such that the replenished toner receiving portion of the conveying fin 3*j* is put in a position deviated to the right of the rotation axis of the screw member 3*e*.

Next, a further embodiment will be described. In this embodiment, the developer receiving portion (connecting port 11*f*) through which the developer circulating path of the first developer stirring and conveying member 3*c* and the developer circulating path of the second developer stirring and conveying member 3*d* communicate with each other, and the toner receiving portion of the toner conveying screw 3*e* for receiving the toner replenished from the toner replenishing portion 4*a* are provided at opposite sides with respect to the rotation axis of the toner conveying screw 3*e*. Therefore, the developer delivered through the connecting port 11*f* and the toner replenished from the toner replenishing port 4*c* can be mixed with good balance.

The developer delivered through the connecting port 11*f* and the toner replenished from the toner replenishing port 4*c* are fed into the toner conveying path of the screw member 3*e* intermittently with fixed cycles, respectively. The cycles are determined by the rotation cycle of the vanes 3*h* provided at the front side of the first developer stirring and conveying member 3*c*, and the rotation cycle of the toner replenishing Mylar 4*e* (FIG. 4) of the toner replenishing unit 4, respectively.

When the developer receiving portion for receiving the developer from the connecting port 11*f* and the toner receiving portion for receiving the replenished toner from the toner replenishing port 4*c* are provided at the same side, the developer delivered through the connecting port 11*f* and the toner replenished from the toner replenishing port 4*c* join at the same timing. In such a case, the developer and the replenished toner are fed into the toner conveying path of the screw member 3*e* while forming lumps intermittently with fixed cycles, respectively. It is therefore difficult to mix the developer delivered through the connecting port 11*f* and the toner replenished from the toner replenishing port 4*c* with good balance, or takes a long time or requires a long conveying distance to mix them with good balance.

In contrast, when the developer receiving portion for receiving the developer from the connecting port 11*f* and the toner receiving portion for receiving the toner from the toner replenishing port 4*c* are provided at opposite sides with respect to the rotation axis of the screw member 3*e*, the developer delivered through the connecting port 11*f* and the toner replenished from the toner replenishing port 4*c* join with timing cycles deviated from each other by a half rotation of the screw member 3*e*. The developer and the replenished toner are dispersed independently in the direction of the toner conveying path while the screw member 3*e* goes half round, and then the developer and the replenished toner join within the toner conveying path of the screw element 3*e*.

According to this embodiment, since the replenished toner particles are dispersed uniformly before mixing it with the circulated developer, the developer and the replenished toner can be mixed with good balance.

Figure 12A:
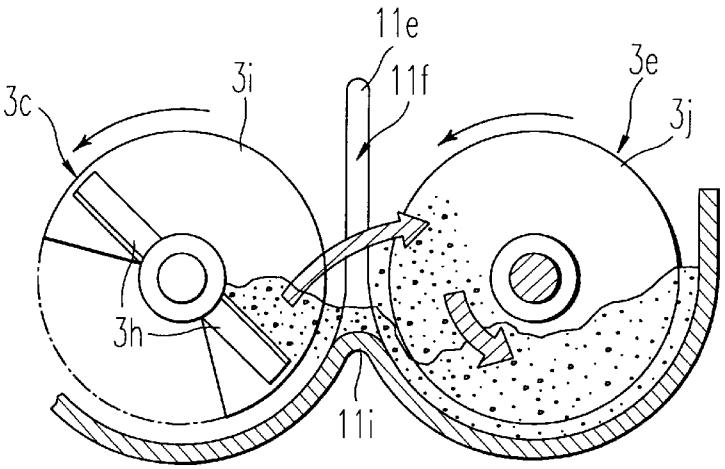
FIG. 12(*a*) is a sectional view showing the positional relationship between a developer receiving portion and a toner replenishing portion according to another embodiment of the present invention, where a screw member as a toner delivering member rotates in a counter-clockwise direction.
Figure 12B:
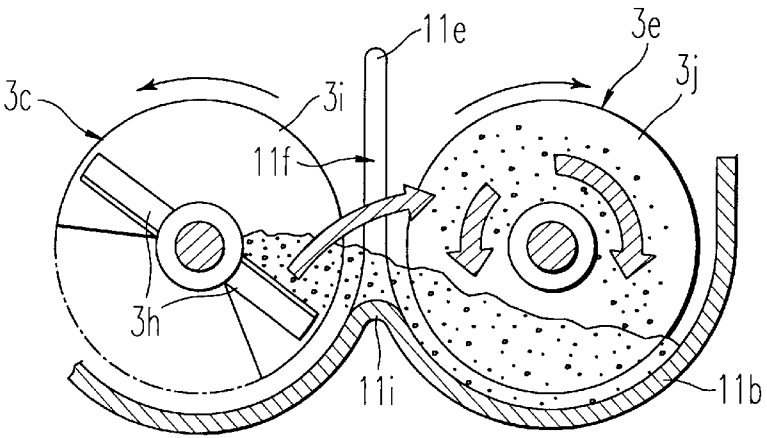

As shown in FIG. 12(*a*), the rotating direction of the screw member 3*e* (second developer stirring and conveying member 3*d*) is basically set in the embodiment to the counterclockwise direction in the same manner as in the above embodiments. When the screw member 3*e* rotates in the counterclockwise direction, the developer delivered from the first developer stirring and conveying member 3*c* through the connecting port 11*f* can be taken into the toner conveying path of the screw member 3*e* quickly, thereby preventing the developer from accumulating near the connecting port 11*f*. As shown in FIG. 12(*b*), even when the screw member 3*e* rotates in the clockwise direction, the developer can be delivered to the replenished toner within the toner conveying path of the screw member 3*e* from the upside of the screw member 3*e* to the both sides of the rotation axis thereof, thereby accelerating the diffusion of the replenished toner into the developer.

Next, a further embodiment will be described. This embodiment features that (a) the developer fed through the receiving portion or connecting port 11*f* is delivered to the second developer stirring and conveying member 3*d* from the upside thereof, (b) the toner fed from the replenishing portions (recycle toner delivering portion 12*d* and toner replenishing port 4*c*) is delivered to the second developer stirring and conveying member 3*d* from the downside thereof, and (c) a toner concentration detecting unit is arranged in a position where the developer and the toner are mixed by the second developer stirring and conveying member 3*d*.

The feature (b) will be first described for convenience sake. In the embodiment, there are two kinds of replenishment of toner to the second developer stirring and conveying member 3*d*; the first kind is recycle toner replenishment for replenishing recycle toner from the recycle toner receiving portion 12*d* by means of the toner recycling belt 12 and the second kind is new toner replenishment for replenishing new toner from the toner replenishing port 4*c*.

In the former replenishment from the recycle toner receiving portion 12*d*, the toner recycling belt 12 is moved in a direction indicated by the arrows in FIG. 4 and the fins 12*c* on the toner recycling belt 12 scrapes the recycle toner from the toner recycling belt 12 and feeds it to the downside of the screw member 3*e*. Therefore, the recycle toner is delivered to the second developer stirring and conveying member 3*d* from the downside thereof, and moved in the direction of the arrow 26 (FIG. 5) in the condition that it is accumulated on the lower side of the screw member 3*e*.

Figure 15:
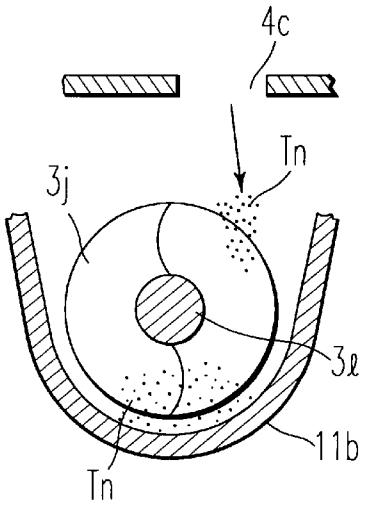
FIG. 15 is a sectional view showing a falling state of toner from the toner replenishing port to the toner conveying member.

In the latter replenishment of new toner from the toner replenishing port 4*c*, the toner replenishing port 4*c* is provided above the screw member 3*e* in a position deviated from the axis 31 of the screw member 3*e*, as shown in FIG. 5 or FIG. 15. Therefore toner Tn from the toner replenishing port 4*c* directly fall on the conveying fin 3*j* without any affect of the axis 31 and reaches the lower portion. The toner Tn in the lower portion is moved in the direction of the arrow 26 in the condition that it is accumulated on the lower side of the conveying fin 3*j*. Thus, when passing through the connecting port 11*f* in the axial direction of the axis 31, the toner Tn is moved in the condition that it is accumulated on the lower side of the conveying fin 3*j* as the screw member 3*e* rotates.

Figure 13:
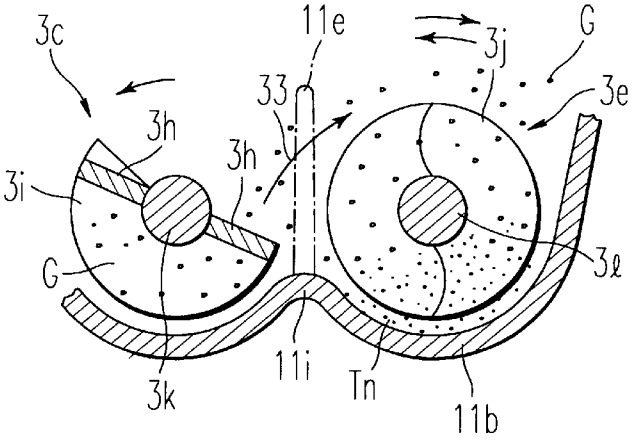
FIG. 13 is a sectional view showing a structure of a developer receiving portion according to another embodiment of the present invention.

The feature (a) will now be described. In FIG. 13, a portion of the lower case 11*b* between the first developer stirring and conveying member 3*c* and the second developer stirring and conveying member 3*d* is formed into a chevron-like shape along which the first developer stirring and conveying member 3*c* and the second developer stirring and conveying member 3*d* rotate, respectively. The first developer stirring and conveying member 3*c* rotates such that the vanes 3*h* scrapes up developer G from the downside to the upside along the chevron-like shape as shown by arrow 33, and supplies the developer G from the upside of the second developer stirring and conveying member 3*d*. When viewed from the second developer stirring and conveying member 3*d*, the developer G is received from the upside.

As shown in FIG. 13, since the developer G the weight of which is heavy is supplied from the upside to the toner Tn in the lower portion of the conveying fin 3*j* of the screw member 3*e*, the developer G falls into the toner Tn, covers the toner Tn therewith and is stirred, so that the developer G and the toner Tn can be stirred and mixed quickly and smoothly.

Although the embodiment teaches that the lower case 11*b* is formed into the chevron-like shape so that the developer G can be delivered from the upside of the second developer stirring and conveying member 3*d* and the rotating direction of the first developer stirring and conveying member 3*c* is set to the direction to scrape up the developer G, such a structure is just an example and other means may be used for supplying the developer G from the upside of the second developer stirring and conveying member 3*d*.

The feature (c) will now be described. In this embodiment, a toner concentration detecting unit is arranged in a position where the developer G and the toner Tn are well mixed by the second developer stirring and conveying member 3*d* as in FIG. 13. The toner concentration detecting unit may be, for example, a toner concentration detecting sensor for measuring magnetic permeability. Although the amount of toner to be replenished is controlled on the basis of the detection results from the toner concentration detecting sensor, such control is performed on the assumption that the toner to be detected by the toner concentration detecting sensor is well dispersed into the developer. Accordingly, the amount of toner to be replenished cannot be controlled accurately unless the toner concentration detecting sensor detects the concentration of toner in a position where the developer and the toner are mixed sufficiently. In the embodiment, the features (a) and (b) meet the requirements for good mixing of the developer G and the toner Tn by means of the second developer stirring and conveying member 3*d*. Therefore, the toner concentration detecting sensor can be put in position on condition that the features (a) and (b) meet the requirements for good mixing of the developer and the toner.

Good mixing of the developer G and the toner Tn using the second developer stirring and conveying member 3*d* denotes that the toner Tn is dispersed into the developer sufficiently. Such sufficient dispersion reduces the rise time for charging the toner to the saturated level with friction between the toner and the carrier, so that toner charged to a fixed level can be obtained in a short time. Therefore, when the toner concentration detecting sensor 16 is arranged in the position where the developer and the toner are well mixed, the amount of toner to be replenished can be controlled adequately according to the image density.

The following experiment (experiment 1) was performed on purpose to verify that the charge of toner rises fast in a position where the developer G and the toner Tn are well mixed, i.e., the toner Tn is dispersed into the developer sufficiently.

[EXPERIMENT 1]

A developer used in electronic copying machines called the Imagio DA series (trademark of Ricoh Co., Ltd.) and the image forming device of FIG. 5 were used in this experiment. In the image forming device, a toner of 0.6 g/min was replenished to the second developer stirring and conveying member 3*d*, and added to the developer the initial toner concentration of which is 5% by weight. The conveying speed of the second developer stirring and conveying member 3*d* was set to 10 mm/min. The developer was sampled at points of 20 mm, 60 mm and 100 mm on the scale having zero point in a position corresponding to the developer receiving portion (connecting port 11*f*) in FIG. 5. Under such conditions, the full charge time (saturation time) was measured for each sampled developer while stirring the samples with a developer stirring device. The measurement results are shown in FIG. 16.

Figure 16:
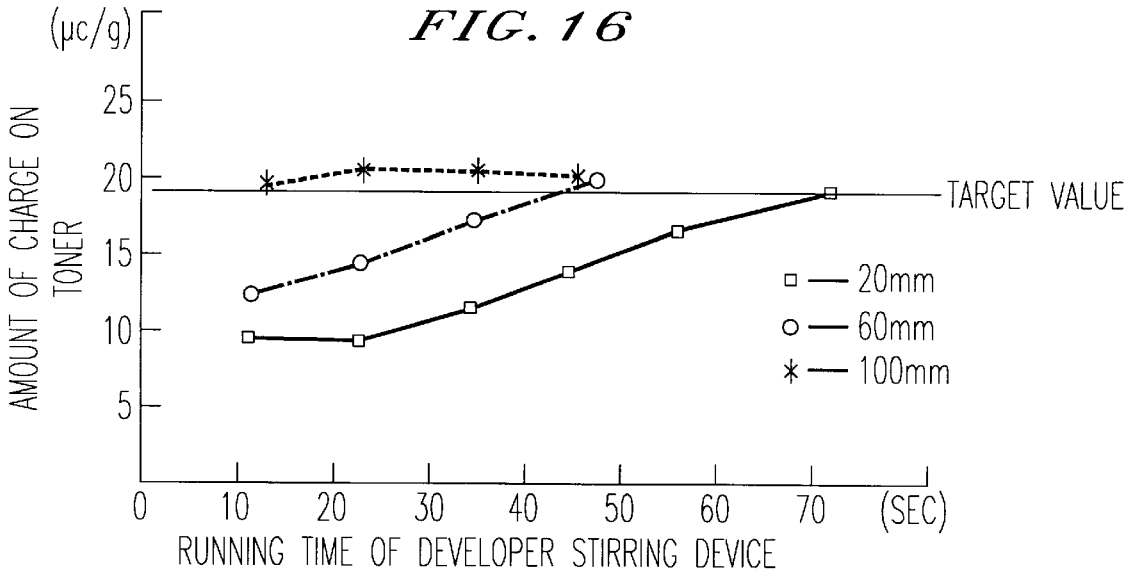
FIG. 16 is a graph showing charge characteristics of toner.

In FIG. 16, a charge characteristic of toner in the developer sampled at a point of 20 mm is marked with a cross (x), a charge characteristic of toner in the developer sampled at a point of 60 mm is marked with a circle (én), and a charge characteristic of toner in the developer sampled at a point of 100 mm is marked with an asterisk (*). The charge characteristic with the crosses rises slowly compared to the running time of the developer stirring device. It is considered that such a slow rise is caused by the nearest position 20 mm distance from the developer receiving portion (connecting port 11*f*), where the toner has not been dispersed into the developer enough for full charge of the toner with friction between the toner and the carrier. The charge characteristic with the asterisks rises fastest compared to the running time of the developer stirring device, and it is considered that such a rise is caused by the farthest position 100 mm distance from the developer receiving portion (connecting port 11*f*), where the toner has been dispersed into the developer enough for full charge of the toner with friction between the toner and the carrier. As a result of this experiment, the toner concentration detecting sensor can be put properly in a position of 100 mm on the scale.

Figure 27:
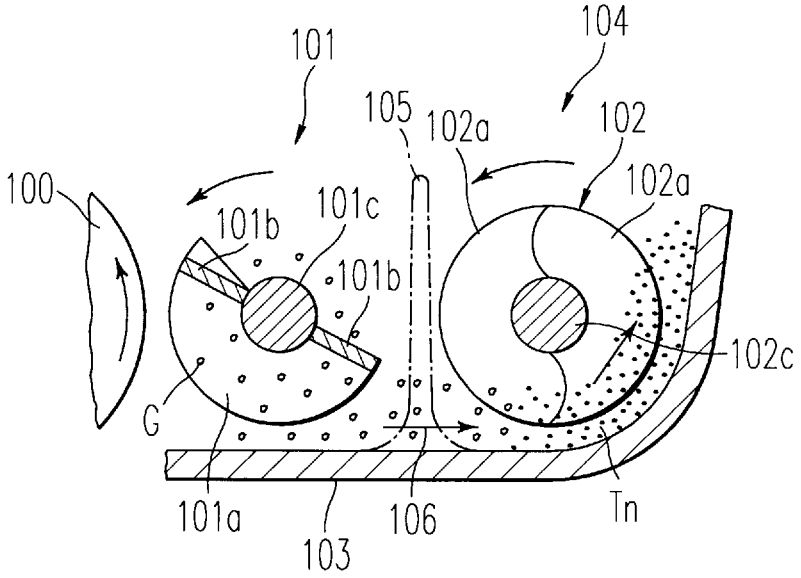
FIG. 27 PRIOR ART
FIG. 27 is a sectional view illustrating a related device.

The following experiment 2 was performed on purpose to compare the toner mixing performance in the conventional case shown in FIG. 27 with the toner mixing performance in the case according to the present invention shown in FIG. 13.

[EXPERIMENT 2]

Figure 17:
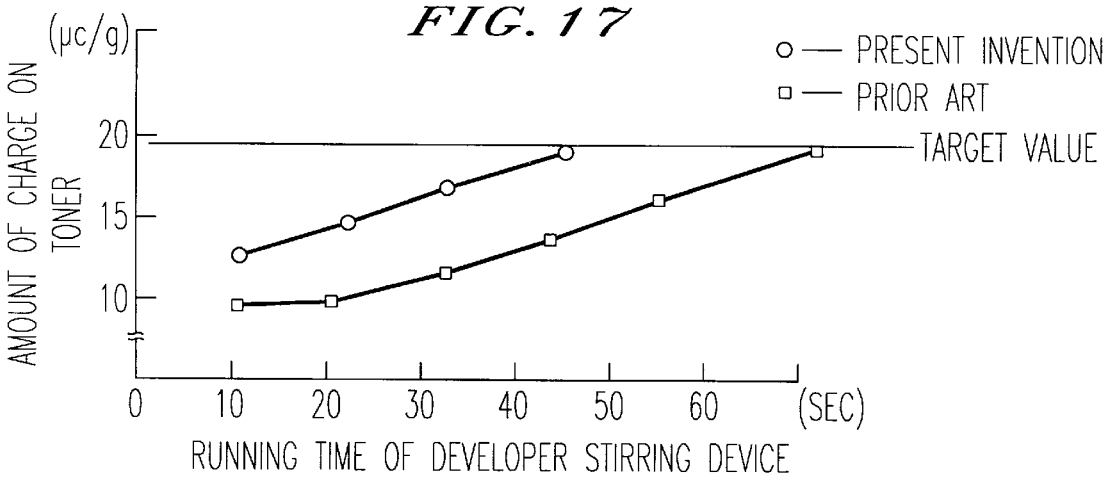
FIG. 17 is a graph showing further charge characteristics of toner.

In this experiment, the developer was sampled at the point of 60 mm on the scale in FIG. 5 respectively under the structure and the operation shown in FIG. 27 and the structure and the operation shown in FIG. 13. Under such conditions, the full charge time (saturation time) was measured for each sampled developer while stirring the samples with a developer stirring device. The measurement results are shown in FIG. 17. In FIG. 17, a charge characteristic of toner in the developer sampled under the structure and the operation according to the present invention shown in FIG. 13 is marked with a circle, and a charge characteristic of toner in the developer sampled under the structure and the operation of the conventional device shown in FIG. 27 is marked with a cross. As apparent from the measurement results, the charge characteristic marked with the circles rises to the target value faster than that marked with the crosses. Such results prove that the charge rising characteristic obtained by satisfying the conditions (a) and (b) is excellent compared to the conventional device.

As discussed in the above experiments, the toner concentration detecting sensor 16 can be arranged anywhere around the second developer stirring and conveying member 3*d* under the structure and the operation shown in FIG. 13 as long as it is put in the position represented by 100 mm on the scale where the developer and the toner are well mixed. The following experiment 3 was performed on purpose to determine which position around the second developer stirring and conveying member 3*d* the toner concentration detecting sensor 16 should be arranged.

[EXPERIMENT 3]

Figure 14:
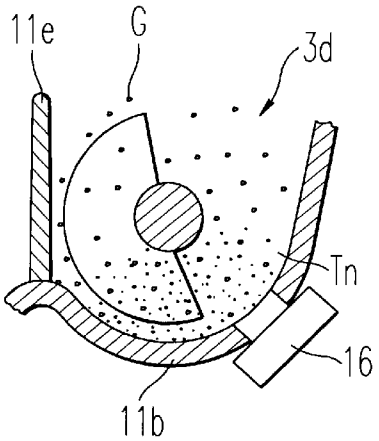
FIG. 14 is a sectional view showing a position of a toner concentration sensor.
Figure 18:
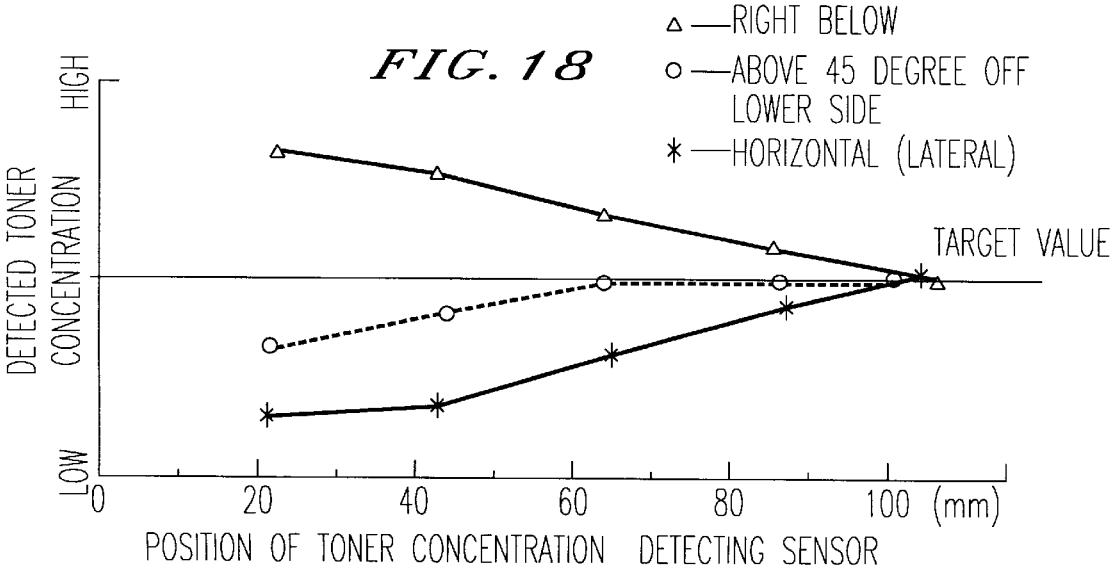
FIG. 18 is graph showing detection characteristics of the toner concentration detecting sensor.

In this experiment, the toner concentration detecting sensor 16 was placed in three positions around the second developer stirring and conveying member 3*d*, i.e., it was placed right below, in the horizontal direction and off the lower side. Then a comparison was made among the values of toner concentration detected in respective positions based on the point on the scale. The comparison results are shown in FIG. 18. In FIG. 18, a triangle (âó) represents a detection result when the toner concentration detecting sensor 16 is arranged right below, a cross represents a detection result when the toner concentration detecting sensor 16 is arranged in the horizontal direction, and a circle represents a detection result when the toner concentration detecting sensor 16 is arranged about 45° off the lower side. As shown in FIG. 14, the position 45° off the lower side denotes a case where the toner concentration detecting sensor 16 is arranged 45 off the lower side of the second developer stirring and conveying member 3*d*.

As apparent from FIG. 18, all the cases finally obtain the target value at the point of 100 mm on the scale, but only the case represented with the circles can obtain the target value at the point of 60 mm on the scale. As previously discussed with respect to FIG. 16, the developers are mixed well at the point of 100 mm on the scale, but the same detection result as at the point of 100 mm can be obtained in the nearer position 60 mm distance from the connecting port 11*f* depending on the arrangement of the toner concentration detecting sensor 16 in spite of insufficient mixing of agents at the point of 60 mm. When the toner and the developer are stirred under the conditions (a) and (b), if the toner concentration detecting sensor 16 is arranged 45° off the lower side, accurate detection of the toner concentration can be obtained in a position closer to the receiving portion than the position in which the toner and the developer are well mixed. Such an arrangement makes it possible to replenish toner immediately according to the image density.

Referring next to FIGS. 19 through 26, description will be made to an embodiment for preventing scattering of toner and hence smudges on the background of an image.

In the embodiment, the pitch (P) and the outside diameter (D) of the stirring fins of the first developer stirring and conveying member 3*c* and the second developer stirring and conveying member 3*d* exhibit the following relationship: P=(⅓ to ⅘)×D.

When the pitch is too small, the conveying force decreases and hence the number of rotations increase, which causes deterioration of the developer. When the pitch is too large, mixing performance lowers.

Further, the first developer stirring and conveying member 3*c* and the second developer stirring and conveying member 3*d* have the same pitch (P), outside diameter (D) and number of rotations, and the peripheral speed (Vscrew) thereof and the peripheral speed Vs of the developing sleeve 3*a* exhibit the following relation: Vs=(1.1 to 1.5)×Vscrew.

When the peripheral speed Vscrew is too high, the stress to the developer becomes large. On the other hand, when it is too low, it takes a long time to supply or recover the developer to or from the developing sleeve 3*a* and thereby uneven concentration may be caused to an image.

In the embodiment, the gap between the first developer stirring and conveying member 3*c* and the second developer stirring and conveying member 3*d* and the developing casing 11 (cases 11*a* and 11*b*) or the partition 11*e* is set to 0.5 to 2 mm so that a leakage of the developer will be prevented. If the gap is too narrow, the developer will be deteriorated while it is rubbed with the first developer stirring and conveying member 3*c* or the second developer stirring and conveying member 3*d* and the developing casing 11 or the partition 11*e*. The gap between the first developer stirring and conveying member 3*c* and the developing sleeve 3*a* is set to 1.5 to 3.0 mm on purpose to supply or recover the developer smoothly. If the gap is too wide, the efficiency of supplying or recovering the developer will be lowered. Conversely, if the gap is too narrow, nonuniform supply or deterioration of the developer caused by stress will occur.

Figure 19:
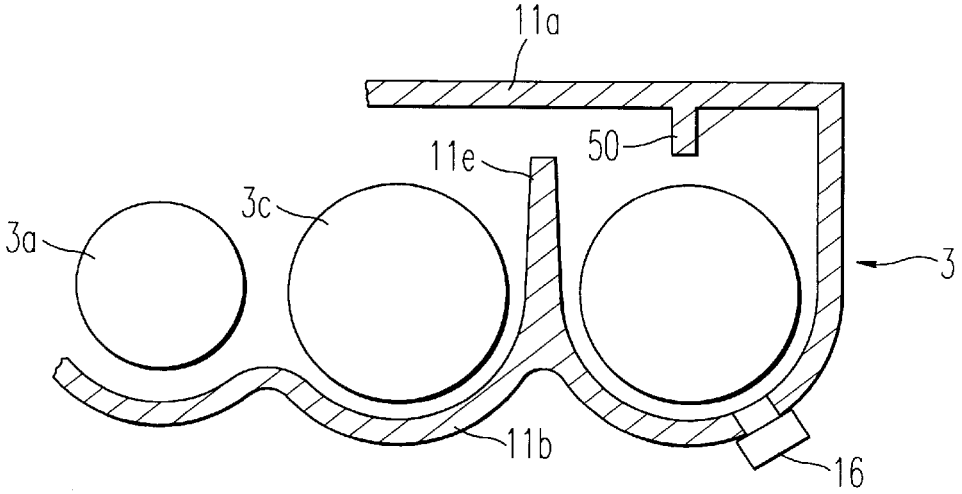
FIG. 19 is a schematic sectional view showing the main parts of an image forming device according to another embodiment of the present invention.

As shown in FIG. 19, a scattering prevention member 50 is provided above the second developer stirring and conveying member 3*d* located farthest away from the developing sleeve 3*a* in the longitudinal direction of the second developer stirring and conveying member 3*d*, so that the scattered toner cannot arrive directly at the developing sleeve 3*a* or the developer around the developer sleeve 3*a*. The scattering prevention member 50, having a fixed height in the longitudinal direction, is located right above the rotation center of the second developer stirring and conveying member 3*d* or in the neighborhood. In the embodiment, the scattering prevention member 50 is unitarily formed with the lower side of the upper case 11*a*.

Such a member 50 prevents scattered or floating toner particles from passing through between the upper case 11*a* and the partition 11*e*.

Figure 20:
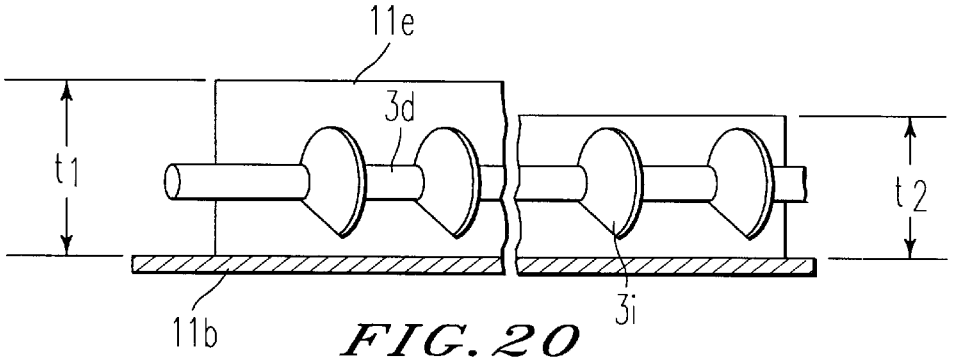
FIG. 20 is a sectional view showing the main parts of a scattering prevention function of a partition.

As shown in FIG. 20, the partition 11*e* is formed into such a tapered shape as the toner replenishing side is higher and the opposite side is lower than the normal case (t1>t2). Since the neighborhood of the toner replenishing port 4*c* is a position in which the toner replenished from the toner cycling mechanism and the recycle toner flowing in from the first developer stirring and conveying member 3*c* join, the flow of toner becomes unstable and scattered or floating toner particles increase. It is therefore necessary to form the partition lie higher in this position in order to prevent the toner from going around or jumping over the partition 11*e*, i.e., prevent scattering of toner particles. On the other hand, since the height of the partition 11*e* is low on the other side, the tolerance for accumulation of toner which may be caused by the damage to the conveying fin or stirring fins is high.

In the embodiment, there are provided both the scattering prevention member 50 and the partition 11*e*, so that scattering preventing effects different from each other can be obtained, thereby preventing the toner from scattering or floating precisely while maintaining the normal flow of developer.

Figure 21:
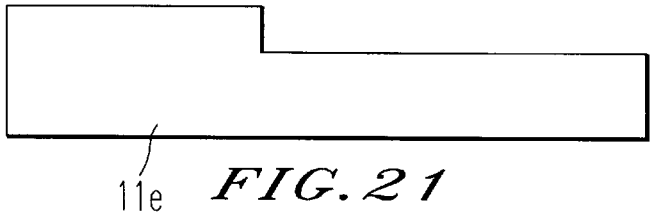
FIG. 21 is a side view showing a modification of the partition.

The shape of the partition 11*e* is not limited by the tapered one as described above and it may be formed into a step-like shape, as shown in FIG. 21, where the toner replenishing side is high over a given range and the opposite side is low.

Figure 22:
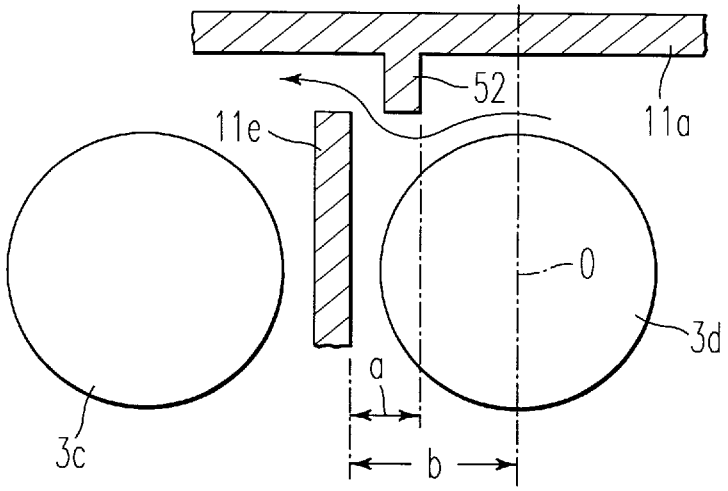
FIG. 22 is a sectional view showing the main parts of a modification of a scattering prevention member.

FIG. 22 shows another embodiment of a scattering prevention member. A scattering prevention member 52 in this embodiment has the same structure as that in the above embodiment, but is different in that the scattering prevention member 52 is provided in a position deviated from the rotation center O of the second developer stirring and conveying member 3*d* toward the partition 11*e* (a<b), and that the upper end of the partition 11*e* and the lower end of the scattering prevention member 52 are set substantially to the same level. As shown by the arrow in FIG. 22, such a structure refracts the flow of air from the second developer stirring and conveying member 3*d* toward the developing sleeve 3*a* and could resist the flow of air. As a result, the scattering of toner is prevented not only by the collision of the toner with the scattering prevention member 52 but also by resisting the flow of air.

In FIG. 22, the gap between the second developer stirring and conveying member 3*d* and the upper case 11*a* is set to 0.3 mm to 2.0 mm (0.5 mm in the embodiment). The shaft diameter of the second developer stirring and conveying member 3*d* is set to 3 mm to 7 mm (6 mm in the embodiment) by taking into account a deflection of the second developer stirring and conveying member 3*d* caused by the rotation. Since the gap is set by taking into account the deflection of the second developer stirring and conveying member 3*d*, the second developer stirring and conveying member 3*d* does not strike the casing, so that almost all developer can be conveyed through the gap between the second developer stirring and conveying member 3*d* and the casing.

Figure 23:
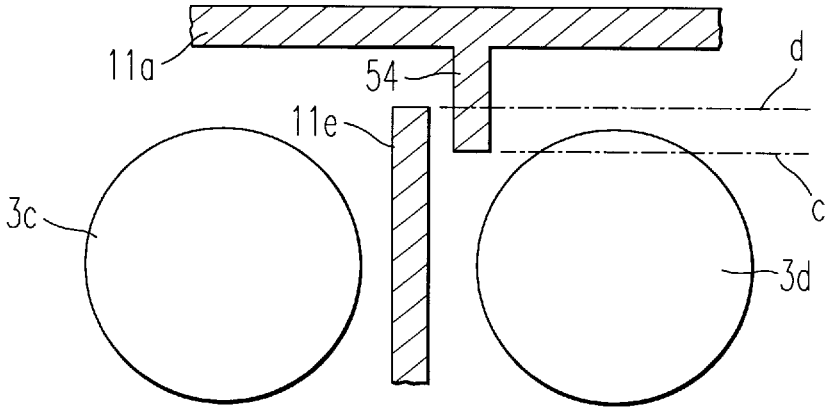
FIG. 23 is a sectional view showing the main parts of another modification of the scattering prevention member.

FIG. 23 shows a further embodiment of a scattering prevention member. A scattering prevention member 54 in this embodiment is provided in a position deviated from the rotation center O of the second developer stirring and conveying member 3*d* toward the partition 11*e*, with the lower end c of the scattering prevention member 54 set lower than the upper end d of the partition 11*e* (or the upper end of the partition 11*e* set higher than the lower end of the scattering prevention member 54). Since such a structure could further resist the flow of air, a high scattering prevention effect can be obtained.

Figure 24:
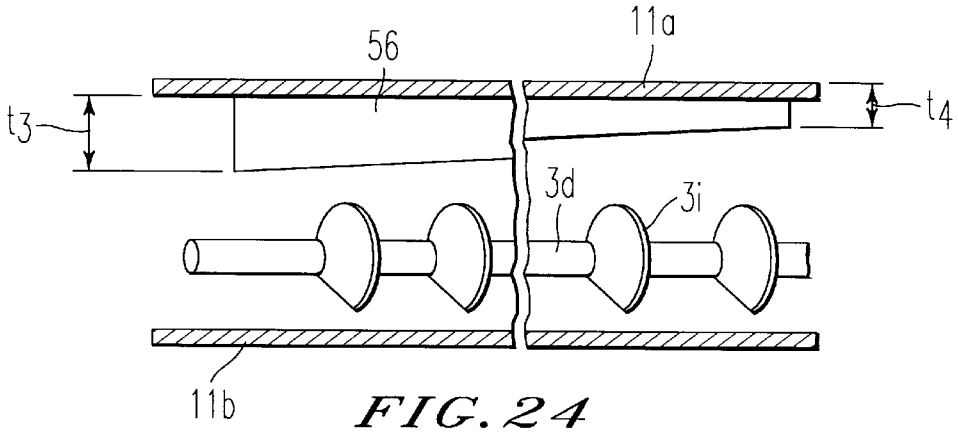
FIG. 24 is a sectional view showing the main parts of still another modification of the scattering prevention member.

FIG. 24 shows a further embodiment of a scattering prevention member. A scattering prevention member 56 in this embodiment is formed into such a tapered shape as the lower end on the toner replenishing side is lower than that on the opposite side (t3>t4). Such a structure improves the tolerance for accumulation of toner caused by the damage to the screw or the like while maintaining its scattering prevention effect.

Figure 25:
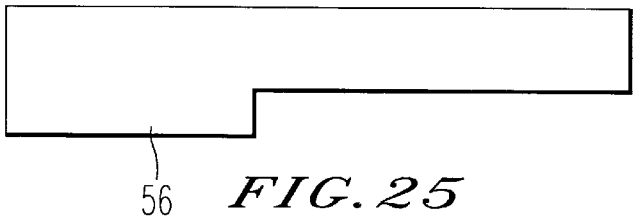
FIG. 25 is a side view showing a modification of the scattering prevention member.

The shape of the scattering prevention member 56 is not limited by the tapered one and it may be formed into a step-like shape, as shown in FIG. 25, where the toner replenishing side is low over a given range and the opposite side is high.

Figure 26:
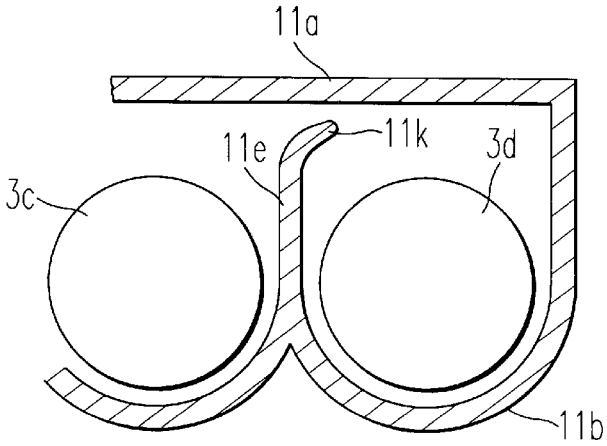
FIG. 26 is a sectional view showing the main parts of a modification of the partition.

Further, as shown in FIG. 26, the upper end 11*k* of the partition 11*e* may be bent toward the second developer stirring and conveying member 3*d* to prevent the scattered toner from going around the partition 11*e*.

As described above, according to the first aspect of the present invention, the recovered toner is delivered upstream of the new toner replenishing portion of the toner conveying path that communicates with the developer stirring and conveying path, so that the condensed recovered-toner can be dispersed and charged smoothly, thereby obtaining a clear image without smudges on the image surface.

According to the second aspect of the present invention, the conveying speed of the toner conveying member is set higher than that of the developer stirring and conveying member, so that the condensed recovered-toner can be dispersed quickly, thereby further improving the image quality.

According to the third aspect of the present invention, since the developer located at the lowermost-stream side of the developer stirring and conveying member that stirs and conveys the developer to the developer carrier is conveyed downstream of the toner replenishing portion of the toner conveying path so that the developer will be circulated, the replenished toner and the delivered developer can be conveyed by the toner conveying member at relatively high speed to prevent a backflow of the developer into the toner replenishing path due to accumulation of toner near the developer receiving portion, thereby obtaining a clear image without smudges on the image surface.

According to the fourth aspect of the present invention, the conveying speed of the toner conveying member is set higher than that of the developer stirring and conveying member, so that a backflow of the developer can be prevented more securely, thereby further improving the image quality.

According to the fifth aspect of the present invention, since a chevron-like protrusion is formed on the bottom of the connecting port as the developer receiving portion so that the developer passing through the developer receiving portion will be delivered from the upside, diffusion of the replenished toner into the developer can be accelerated.

According to the sixth aspect of the present invention, the toner receiving portion of the toner conveying member is provided in a position deviated from the rotation axis of the toner conveying member, so that intake of the replenished toner to the developer can be accelerated because the rotation axis does not prevent falling of the replenished toner.

According to the seventh aspect of the present invention, the replenished toner receiving portion of the toner conveying member is rotated in the same direction as the toner is replenished, so that the tangent to the locus of rotation of the conveying member, which touches the locus at a point located right below the toner receiving portion, is directed to the same direction as the falling direction of the replenished toner, so that intake of the replenished toner to the developer can be accelerated more, thereby preventing scattering of the replenished toner.

According to the eighth aspect of the present invention, since the developer receiving portion and the toner receiving portion of the toner conveying member are formed at opposite sides with respect to the rotation axis of the toner conveying member, the delivered developer and the replenished toner join with timing cycles deviated from each other by half rotation of the toner conveying member after the developer and the replenished toner are dispersed independently in the direction of the toner conveying path while the conveying member goes half round, so that the developer and the replenished toner can be mixed with good balance.

According to the ninth aspect of the present invention, a toner concentration detecting unit is put in a position in which the developer and the toner are stirred and mixed well, so that the toner replenishment can be controlled accurately.

According to the tenth aspect of the present invention, the developer can be supplied to the second developer stirring and conveying member from the upside thereof.

According to the eleventh aspect of the present invention, the same detection results when the toner and the developer has actually been mixed well can be obtained at a point prior to the point at which mixing of the toner and the developer actually becomes good balance.

According to the twelfth aspect of the present invention, the scattering prevention member is provided above one of the developer stirring and conveying members located farthest away from the developer carrier and along the axial direction of the developer stirring and conveying member so that toner particles scattered or floating when replenishing the toner cannot arrive directly at the developer carrier or the developer around the developer carrier without being charged or with weak electrification, and this makes it possible to effectively prevent the scattered or floating toner particles from going around, thereby preventing smudges on the image surface or stains in the device.

According to the thirteenth aspect of the present invention, the scattering prevention member is positioned on the side of the partition with respect to the rotation axis of the developer stirring and conveying member that is the farthest one from the developer carrier, and such a structure could resist the flow of air from the developer stirring and conveying member to the developer carrier, so that the movement of the floating toner particles can be protected, thereby preventing scattering of toner or smudges on the image surface.

According to the fourteenth aspect of the present invention, the upper end of the partition is located in a position higher than the lower end of the scattering prevention member and such a structure could further resist the flow of air, thereby preventing scattering of toner or smudges on the image surface more effectively.

According to the fifteenth aspect of the present invention, the upper end of the partition is such that the toner replenishing side is higher than the other side, and this makes it possible to prevent the toner from going around or jumping over the partition. Such a structure also makes it possible to improve the tolerance for (security against) accumulation of toner caused by the damage to the screw or the like.

According to the sixteenth aspect of the present invention, the lower end of the scattering prevention member is such that the toner replenishing side is lower than the other side. As is similar to the fifteenth aspect of the present invention, such a structure makes it possible not only to prevent the toner from going around or jumping over the partition, but also to improve the tolerance for (security against) accumulation of toner caused by the damage to the screw or the like.

Obviously, numerous modifications and variations of the present invention are possible in light of the above teachings. It is therefore to be understood that within the scope of the appended claims, the invention may be practiced other than as specifically described herein.

What is claimed as new and desired to be secured by Letters Patent of the United States is:

1. An image forming device having a developer stirring and conveying member for stirring and conveying developer to a developer carrier developing an electrostatic latent image on an image carrier; a toner conveying member provided through a toner conveying path for conveying toner to a developer stirring and conveying path of the developer stirring and conveying member that communicates with the toner conveying path; a new toner replenishing member for replenishing new toner to the toner conveying member; and a recovered toner conveying member for conveying toner, recovered from the surface of the image carrier, to the toner conveying member, wherein:

the recovered toner is conveyed upstream of a new toner replenishing portion of said toner conveying path, and a conveying speed of said toner conveying member is set higher than a conveying speed of said developer stirring and conveying member.

2. An image forming device having a developer stirring and conveying member for stirring and conveying developer to a developer carrier developing an electrostatic latent image on an image carrier; a toner conveying member provided through a toner conveying path for conveying toner to a developer stirring and conveying path of the developer stirring and conveying member that communicates with the toner conveying path; and a toner replenishing member for replenishing toner to the toner conveying member, wherein:

developer located at a lowermost-stream side of said developer stirring and conveying member is conveyed downstream of a toner replenishing portion of said toner conveying path to circulate the developer.

3. The image forming device according to claim 2, wherein a conveying speed of said toner conveying member is set higher than a conveying speed of said developer stirring and conveying member.

4. The image forming device according to claim 2, wherein a chevron-like protrusion is formed on a bottom of a developer conveying portion located at the lowermost-stream side of said developer stirring and conveying member so that the developer will be conveyed from an upside of said toner conveying path.

5. The image forming device according to claim 2, wherein a toner receiving portion of said toner conveying member for receiving toner replenished from said toner replenishing portion is provided in a position deviated from a rotation axis of said toner conveying member.

6. The image forming device according to claim 5, wherein the toner receiving portion of said toner conveying member is rotated in a same direction as the toner is replenished from said toner replenishing portion.

7. The image forming device according to claim 2, wherein a developer conveying portion located at a lowermost-stream side of said developer stirring and conveying member and a toner receiving portion of said toner conveying member are formed at opposite sides with respect to a rotation axis of said toner conveying member.

8. An image forming device having a developer stirring and conveying member which is provided with a developer receiving portion for receiving circulated developer and a toner replenishing portion for receiving replenished toner, the toner replenishing portion being located outside of the developer receiving portion in an axial direction of said developer stirring and conveying member, wherein:

said developer stirring and conveying member receives developer from an upside thereof through said developer receiving portion and toner from a downside thereof through said toner replenishing portion, and a toner concentration detecting unit is put in a position where the developer and the toner are mixed by said developer stirring and conveying member.

9. The image forming device according to claim 8, wherein when said developer stirring and conveying member for receiving developer is used as a second developer stirring and conveying member, a first developer stirring and conveying member is provided in a lateral direction of the second developer stirring and conveying member such that the first and second developer stirring and conveying members stand side by side, the developer being delivered from said first developer stirring and conveying member to said second developer stirring and conveying member through said developer receiving portion while rotating said first developer stirring and conveying member in a direction in which the developer is scraped up and fed to said second developer stirring and conveying member, with a portion of a lower casing between said first developer stirring and conveying member and said second developer stirring and conveying member being formed into a chevron-like shape corresponding to a locus of rotation of said first developer stirring and conveying member and the second developer stirring and conveying member.

10. An image forming device having a developer stirring and conveying member which is provided with a developer receiving portion for receiving circulated developer and a toner replenishing portion for receiving replenished toner, the toner replenishing portion being located outside of the developer receiving portion in an axial direction of said developer stirring and conveying member, wherein:

said developer stirring and conveying member receives developer from an upside through said developer receiving portion and toner from a downside through said toner replenishing portion, and a toner concentration detecting unit is positioned off a lower side of said developer stirring and conveying member as viewed from an axial direction of said developer stirring and conveying member.

11. An image forming device having a developer carrier, a plurality of developer stirring and conveying members arranged horizontally along the developer carrier, a partition provided between the developer stirring and conveying members, connecting passages provided at both ends of the partition so that developer can turn back therethrough, and a toner replenishing means for replenishing toner from an end portion of one of the developer stirring and conveying members, in which an electrostatic latent image formed on an image carrier is made visible with a two-component developer including toner and carrier to form a developed image, wherein:

a scattering prevention member is provided above one of said developer stirring and conveying members located farthest away from said developer carrier and along an axial direction of the developer stirring and conveying member so that toner particles scattered when replenishing the toner cannot directly arrive at said developer carrier or the developer around said developer carrier.

12. The image forming device according to claim 11, wherein said scattering prevention member is positioned on a side of said partition with respect to a rotation axis of said developer stirring and conveying member that is the farthest one from said developer carrier of all the developer stirring and conveying members.

13. The image forming device according to claim 12, wherein an upper end of said partition is located in a position higher than a lower end of said scattering prevention member.

14. The image forming device according to claim 13, wherein a lower end of said scattering prevention member is such that a toner replenishing side is lower than the other side.

15. The image forming device according to claim 12, wherein an upper end of said partition is such that a toner replenishing side is higher than the other side.

16. The image forming device according to claim 12, wherein a lower end of said scattering prevention member is such that a toner replenishing side is lower than the other side.

17. The image forming device according to claim 11, wherein an upper end of said partition is located in a position higher than a lower end of said scattering prevention member.

18. The image forming device according to claim 17, wherein an upper end of said partition is such that a toner replenishing side is higher than the other side.

19. The image forming device according to claim 17, wherein a lower end of said scattering prevention member is such that a toner replenishing side is lower than the other side.

20. The image forming device according to claim 11, wherein an upper end of said partition is such that a toner replenishing side is higher than the other side.

21. The image forming device according to claim 11, wherein a lower end of said scattering prevention member is such that a toner replenishing side is lower than the other side.

* * * * *

UNITED STATES PATENT AND TRADEMARK OFFICE

CERTIFICATE OF CORRECTION

PATENT NO. : 5,887,224

DATED : March 23, 1999

INVENTOR(S) : Haruji MIZUISHI, et al.

It is certified that error appears in the above-identified patent and that said Letters Patent is hereby corrected as shown below:

On the title page, Item [30] should be:

--[30] Foreign Application Priority Data
May 31, 1996 [JP] Japan.....8-138472
May 31, 1996 [JP] Japan.....8-138473
May 29, 1996 [JP] Japan.....8-134584
Jun. 21, 1996 [JP] Japan.....8-161812
Apr. 7, 1997 [JP] Japan.....9-088479--

Signed and Sealed this

Twenty-eighth Day of March, 2000

*Attest:*

Q. TODD DICKINSON

*Attesting Officer*

*Commissioner of Patents and Trademarks*